US011131068B2

(12) United States Patent
Aldahir et al.

(10) Patent No.: US 11,131,068 B2
(45) Date of Patent: Sep. 28, 2021

(54) SHOCK PAD FOR SYNTHETIC TURF AND METHODS FOR MAKING SAME

(71) Applicant: Columbia Insurance Company, Omaha, NE (US)

(72) Inventors: Philipe Aldahir, Chattanooga, TN (US); Tom Odum, Tunnel Hill, GA (US); Jim Burns, Rocky Face, GA (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 0 days.

(21) Appl. No.: 16/373,338

(22) Filed: Apr. 2, 2019

(65) Prior Publication Data

US 2019/0301107 A1 Oct. 3, 2019

Related U.S. Application Data

(60) Provisional application No. 62/651,335, filed on Apr. 2, 2018.

(51) Int. Cl.

| | |
|---|---|
| ***E01C 13/02*** | (2006.01) |
| ***A41G 1/00*** | (2006.01) |
| ***D04H 1/593*** | (2012.01) |
| ***E01C 13/08*** | (2006.01) |
| ***D04H 1/4334*** | (2012.01) |

(52) U.S. Cl.

CPC ..... *E01C 13/02* (2013.01); *A41G 1/009* (2013.01); *D04H 1/4334* (2013.01); *D04H 1/593* (2013.01); *E01C 13/08* (2013.01); *D10B 2331/02* (2013.01); *D10B 2505/202* (2013.01)

(58) Field of Classification Search

CPC ..... E01C 13/02; E01C 13/08; A41G 1/009; D10B 2505/202

USPC ..... 428/17

See application file for complete search history.

(56) References Cited

U.S. PATENT DOCUMENTS

| | | | | |
|---|---|---|---|---|
| 6,221,445 | B1 | 4/2001 | Jones | |
| 6,818,274 | B1 | 11/2004 | Buck et al. | |
| 8,545,964 | B2 * | 10/2013 | Svirklys | E01C 13/02 428/131 |
| 2007/0032157 | A1 | 2/2007 | McGrath et al. | |
| 2010/0151158 | A1 | 6/2010 | Mashburn et al. | |
| 2010/0239790 | A1 * | 9/2010 | Stricklen | E01C 13/02 428/17 |

(Continued)

FOREIGN PATENT DOCUMENTS

| | | | |
|---|---|---|---|
| CA | 2832986 | A1 | 12/2012 |
| CN | 101424068 | A | 5/2009 |

(Continued)

OTHER PUBLICATIONS

Choi, KR 10 2015 0057854 A machine translation, May 28, 2015, entire machine translation (Year: 2015).*

(Continued)

*Primary Examiner* — Humera N. Sheikh
*Assistant Examiner* — Katherine A Christy
(74) *Attorney, Agent, or Firm* — Ballard Spahr LLP

(57) ABSTRACT

Disclosed are methods for making shock absorbing pads utilizing reclaimed artificial turf and reclaimed carpet materials. It is demonstrated that the artificial turf systems comprising inventive pads exhibit improved Head Impact Criteria (HIC) and cradle-to-cradle score.

32 Claims, 20 Drawing Sheets

(56) References Cited

U.S. PATENT DOCUMENTS

| | | | | |
|---|---|---|---|---|
| 2010/0319510 | A1 | 12/2010 | Bearden | |
| 2012/0315816 | A1* | 12/2012 | Fowler | B29B 17/0042 442/327 |
| 2013/0064996 | A1 | 3/2013 | Mashburn | |
| 2013/0280445 | A1 | 10/2013 | McAnany et al. | |
| 2015/0209830 | A1 | 7/2015 | Edwards et al. | |
| 2016/0040367 | A1 | 2/2016 | Allen | |
| 2016/0122943 | A1* | 5/2016 | Brumbelow | D06N 7/0081 428/87 |
| 2019/0345676 | A1* | 11/2019 | van der Wende | E01C 13/083 |

FOREIGN PATENT DOCUMENTS

| | | | |
|---|---|---|---|
| CN | 102808368 | A | 12/2012 |
| CN | 204343135 | U | 5/2015 |
| DE | 4136444 | A1 | 5/1993 |
| GB | 201105755 | | 5/2011 |
| GB | 201414012 | | 9/2014 |
| JP | 2008068177 | A | 3/2008 |
| JP | 2008180074 | A | 8/2008 |
| JP | 4219962 | B1 | 2/2009 |
| KR | 20100104162 | A | 9/2010 |
| KR | 101168686 | B1 | 7/2012 |
| KR | 101175234 | B1 | 8/2012 |
| KR | 101182416 | B1 | 9/2012 |
| KR | 20130032819 | A | 4/2013 |
| KR | 20140147992 | A | 12/2014 |
| KR | 10 2015 0057854 | * | 5/2015 |
| LU | 91522 | A1 | 8/2010 |
| WO | WO-2009/078128 | A1 | 6/2009 |
| WO | WO-2009/84150 | A1 | 7/2009 |
| WO | WO-2016/024044 | A1 | 2/2016 |

OTHER PUBLICATIONS

International Search Report and Written Opinion were dated Jun. 19, 2019 by the International Searching Authority for International Application No. PCT/US2019/025398, filed on Apr. 2, 2019 (Applicant—Shaw Industries Group, Inc.) (9 Pages).

PCT, PCT/US2019/025398, Apr. 2, 2019, Shaw Industries Group Inc.

* cited by examiner

SHOCK PAD FOR SYNTHETIC TURF AND METHODS FOR MAKING SAME

CROSS REFERENCE TO RELATED APPLICATIONS

This application claims the benefit of priority to U.S. Provisional Patent Application No. 62/651,335, filed Apr. 2, 2018. The entire disclosure of the aforementioned patent application is incorporated by reference herein.

TECHNICAL FIELD

The present invention relates generally to shock pads that can, for example, be used in connection with an artificial turf, and methods for making same. The present invention also relates to artificial turf systems comprising the herein described shock pads as an underlayment and methods for the manufacture and installation of same.

BACKGROUND

Synthetic turf has been used for years in athletic playing surfaces such as football, baseball, and soccer fields, and has more recently been used in other applications where an alternative to natural grass is desired. These applications include, for example, playgrounds, residential and commercial lawns and other landscaping, jogging paths, paintball fields, tennis courts, putting greens, and dog runs. Typically, synthetic turf includes a pile fabric having a primary backing and a plurality of upstanding ribbons, also called face fibers or filiform formations, resembling grass. When installed, the turf can also overly an underneath shock pad. Many synthetic turf products also include an infill material dispersed among the upstanding ribbons, which may consist of sand, tire rubber crumb, or other particulates, either singularly or in combination with each other. The infill material simulates the soil in natural turf, acts as a ballast, and/or contributes to the physical properties of the turf, such as resiliency, that make the turf suitable for a particular use.

Conventional shock pads are manufactured from virgin or recycled materials. The use of reclaimed or recycled materials has, until now, first required a pre-sorting or separation of the reclaimed material to ensure the reclaimed material has chemical properties similar to or compatible with the virgin materials. In many cases, it requires separation of carpet or turf carcass due to material dissimilarities. However, such manufacturing is not cost effective, is very time intensive as it requires multiple steps, and it does not provide a desirable cradle-to-cradle product life cycle.

Furthermore, the synthetic turf itself has a limited useful life, the length of which depends on the construction of the turf, the application for which it is used, and how the turf is maintained. As an example, a typical synthetic turf for use as an athletic field may have a useful life of from about 8 to 15 years. To avoid sending these used and worn out turfs and shock pads to landfills at the end of its useful life, there is a need for a method of recycling and reusing all or portions of the synthetic turf. There is also a need in the art for improved shock absorbing pads that can efficiently be constructed of recyclable material and that are themselves readily recyclable.

SUMMARY

The present disclosure is generally directed to shock absorbing pads that can be used as under padding for artificial turf installations. The shock absorbing pad generally comprises a composite nonwoven pad having a face surface and an opposed back surface. The composite nonwoven pad is comprised of a nonwoven blend of at least one reclaimed artificial turf material and a heat set binder material. The at least one reclaimed artificial turf material comprises at least one of face fibers, primary backing fibers, adhesive backing material, or any combination thereof.

In further aspects, also disclosed herein is a method of making a shock absorbing pad. The method generally comprises the steps of forming a composite blend of at least one reclaimed artificial turf material and a binder material; forming the composite blend into a composite web; and treating the composite web under conditions effective to set the binder material and to provide a composite nonwoven pad. The at least one reclaimed artificial turf material comprises at least one of face fibers, primary backing fibers, adhesive backing, or any combination thereof.

Still further, also disclosed herein is an artificial turf system comprising the disclosed shock pads. The artificial turf system generally comprises an artificial turf component comprising a primary backing layer having a face side and a back side and a plurality of turf fibers extending through the backing layer such that a face side portion of the turf fibers extends from the face side of the backing layer. The backside of the artificial turf component overlies a face surface of a shock absorbing pad as disclosed herein.

Additional aspects of the invention will be set forth, in part, in the detailed description, figures, and claims, which follow, and in part will be derived from the detailed description, or can be learned by practice of the invention. It is to be understood that both the foregoing general description and the following detailed description are exemplary and explanatory only and are not restrictive of the invention as disclosed.

DETAILED DESCRIPTION

Figure 1:
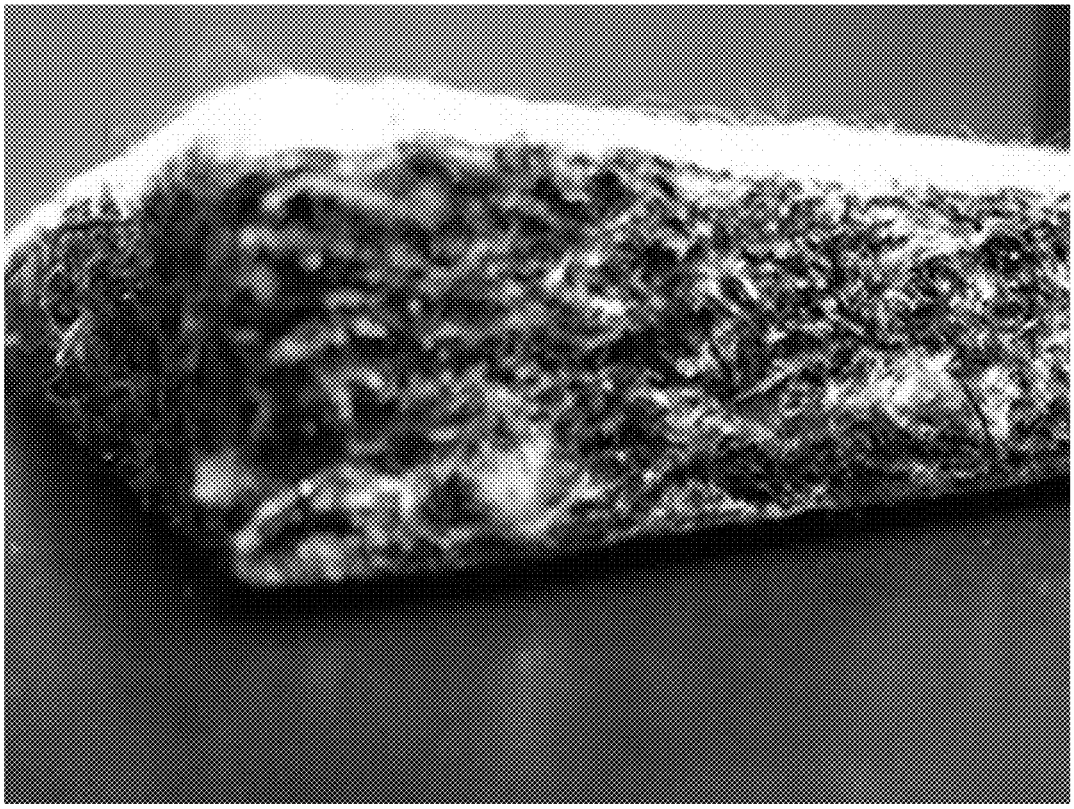
FIG. 1 depicts a photograph of an exemplary pad according to aspects of the present invention.

The present invention can be understood more readily by reference to the following detailed description, examples, drawings, and claims, and their previous and following description. However, before the present articles, systems, and/or methods are disclosed and described, it is to be understood that this invention is not limited to the specific or exemplary aspects of articles, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those of ordinary skill in the pertinent art will recognize that many modifications and adaptations to the present invention are possible and may even be desirable in certain circumstances and are a part of the present invention. Thus, the following description is again provided as illustrative of the principles of the present invention and not in limitation thereof.

Definitions

In this specification and in the claims that follow, reference will be made to a number of terms, which shall be defined to have the following meanings:

Throughout the description and claims of this specification the word "comprise" and other forms of the word, such as "comprising" and "comprises," means including but not limited to, and is not intended to exclude, for example, other additives, components, integers, or steps. Furthermore, it is to be understood that the terms comprise, comprising and comprises as they related to various aspects, elements and features of the disclosed invention also include the more limited aspects of "consisting essentially of" and "consisting of."

As used herein, the singular forms "a," "an," and "the" include plural referents unless the context clearly dictates otherwise. Thus, for example, reference to a "shock pad" includes aspects having two or more such shock pads unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It should be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

As used herein, the term "substantially" can, in some aspects, refer to at least about 80%, at least about 85%, at least about 90%, at least about 91%, at least about 92%, at least about 93%, at least about 94%, at least about 95%, at least about 96%, at least about 97%, at least about 98%, at least about 99%, or about 100% of the stated property, component, composition, or other condition for which substantially is used to characterize or otherwise quantify an amount.

In other aspects, as used herein, the term "substantially free," when used in the context of a composition or component of a composition that is substantially absent, is intended to refer to an amount that is less than about 1% by weight, e.g., less than about 0.5% by weight, less than about 0.1% by weight, less than about 0.05% by weight, or less than about 0.01% by weight of the stated material, based on the total weight of the composition.

References in the specification and concluding claims to parts by weight of a particular element or component in a composition or article, denotes the weight relationship between the element or component and any other elements or components in the composition or article for which a part by weight is expressed. Thus, in a composition or a selected portion of a composition containing 2 parts by weight of component X and 5 parts by weight component Y, X and Y are present at a weight ratio of 2:5, and are present in such ratio regardless of whether additional components are contained in the composition.

A weight percent of a component, unless specifically stated to the contrary, is based on the total weight of the formulation or composition in which the component is included.

As used herein, the term or phrase "effective," "effective amount," or "conditions effective to" refers to such amount or condition that is capable of performing the function or property for which an effective amount or condition is expressed. As will be pointed out below, the exact amount or particular condition required will vary from one aspect to another, depending on recognized variables such as the materials employed and the processing conditions observed. Thus, it is not always possible to specify an exact "effective amount" or "condition effective to." However, it should be understood that an appropriate effective amount will be readily determined by one of ordinary skill in the art using only routine experimentation.

As used herein, and unless the context clearly indicates otherwise, the term "carpet" is used to generically include broadloom carpet, carpet tiles, area rugs, and artificial grass (or turf). To that end, the term "broadloom carpet" refers to a broadloom textile flooring product manufactured for and intended to be used in roll form. The term "carpet tile" refers to a modular floor covering, conventionally manufactured in 18"×18," 24"×24" or 36"×36" squares, but other sizes and shapes are also within the scope of the present invention. Any of these exemplary carpets can be woven, non-woven, tufted, or needle-punched.

As used herein, the term side edge locking structure refers to a profiled edge that forms a locking connection between two adjacent panels such that the two adjacent pads are affixed in a manner that prevents any relative lateral movement between the two pads. In some aspects, a side edge locking structure can be an interlocking structure or mechanism as defined herein. A conventional click lock mechanism is an example of a side edge locking structure. In contrast, it should be understood that conventional tongue and groove profiles that only restrict vertical movement of adjacent panels is not to be considered a side edge locking structure as the tongue and groove profile does not restrict lateral or horizontal displacement. It should therefore be understood that as used herein, aspects that specifically disclaim a side edge locking structure still include (do not exclude) aspects where, for example, the side edge simply abuts another a side edge in view of having no special profile and also include aspects having conventional tongue and groove profiles.

As used herein, the terms "interlocking mechanism" or "interlocking structure" refer to a mechanism that allows an arrangement of various parts of the pads to be connected such that the operation of one part automatically brings about or prevents the operation of another part. The interlocking mechanisms contain locking means that lock pads in at least a horizontal manner and can also include aspects that lock in both a horizontal and vertical direction. Some exemplary interlocking mechanisms contain both a tongue type protrusion and a groove like profile within the same pad. For example, the tongue profile can be machined into one side and one end of the pad with the groove being machined into the opposite side and end of the same pad. Such joints can be made by machining the edges of the pads. Alternatively, parts of the interlocking mechanism can be made of a separate material, which is then integrated with the pad. It is understood that the term "interlocking mechanism" is not construed to be limited to the tongue and groove profiles only of the disclosed pads. Other exemplary interlocking mechanisms include snapping connections incorporated into the pad edges, angling pads with interlocking edges, pads with overlapping edges, pads with the puzzle-lock edges, pads with slopping edges etc. It is understood that the term "interlocking mechanism" allows a plurality of pads to be readily joined in interlocking relationship such that when assembled, there is no necessity for separate structural frames.

As used herein, "reclaimed carpet material" refers generally to any material obtained from a prior manufactured carpet product. The prior manufactured carpet product can be a post-consumer product, such as, for example, a post residential, a post commercial, a post-industrial carpet, or a reclaimed artificial grass. In aspects, where the reclaimed carpet material comprises an artificial grass, the reclaimed artificial grass can be collected from any field, from example, an indoor, an outdoor, or a gym, after any amount of use. As used herein, "reclaimed synthetic turf material" refers generally to any material obtained from a prior manufactured synthetic turf product. The prior manufactured synthetic turf product can be a post use or post-consumer product recovered from a point of original installation. Alternatively, the reclaimed carpet material can be a pre-consumer product, such as manufacturing remnants or quality control failures. In the aspects, where the reclaimed carpet material is the reclaimed artificial grass, the artificial grass can be also a pre-consumer product.

As described in detail in the U.S. Pat. No. 9,011,740, the entire disclosure of which is incorporated herein by reference, conventional synthetic turf typically includes a pile fabric having a backing and a plurality of upstanding ribbons, also called face fibers or filiform formations, resembling blades of grass. Typically, the upstanding ribbons are made of polyethylene, polypropylene, or a blend thereof. The ribbons may also be made of nylon or any other material known in the art alone or in combination with polypropylene and/or polyethylene. These face fibers are tufted or sewn into a primary backing material, which can be made of a number of different materials including, but not limited to, polypropylene and polyester. An adhesive coating material, or precoat, is commonly applied to the fiber and primary backing to hold the face fibers in place. In some aspects, the primary coating of synthetic turfs includes polyurethane and also typically includes a filler such as calcium carbonate or coal fly ash. The primary coatings may also include latex, hot melt adhesives, and/or thermoplastics in addition to or instead of polyurethane. Synthetic turfs may also have a secondary coating, which may be similar to the primary coating described herein. Synthetic turfs may also have a secondary backing, which can be made of a number of different materials including, but not limited to, polypropylene and polyester. Synthetic turfs can be manufactured in the form of roll goods or, alternatively, can be manufactured in the form of tiles or panels of any desired length and width dimension.

As used herein the terms "synthetic turf" or "artificial turf" or "artificial grass" can be issued interchangeably and include any form of artificial grass or turf conventionally used, for example, in athletic playing surfaces such as football, baseball, and soccer fields, and in other applications where an alternative to natural grass is desired. These applications include at least playgrounds, residential and commercial lawns, and other landscaping, jogging paths, paintball fields, tennis courts, putting greens, dog runs, landfill covers, medians and other areas near roadways, and airport grounds near runways.

Besides the locking means provided by the shock pads disclosed herein, the interlocking mechanism, as defined herein, can further include locking elements. In some examples, such locking elements can include strips with salient features that engage the locking element onto two adjacent pads.

Shock Absorbing Pad

As summarized above, disclosed herein is a shock absorbing pad. FIGS. 22-29 show schematic representations of an exemplary shock absorbing pad according to the aspects of this disclosure. In some aspects, the shock absorbing pad comprises a composite nonwoven pad 100 having a face surface 102 and an opposed back surface 104. The nonwoven pad is comprised of a nonwoven blend 110 of at least one reclaimed artificial turf 110A material and a heat set binder material 110B. The at least one reclaimed artificial turf material comprises at least one of face fibers, primary backing fibers, primary coating material, adhesive backing material, filler, infill, or any combination thereof. Depending on the component part(s) of synthetic turf reclaimed, it should be appreciated that reclaimed synthetic turf material can include any one or more of the materials described below as being used in the manufacture of conventional synthetic turf. An exemplary shock pad according to the present disclosure is also shown in FIG. 1. An exemplary shock pad according to the present disclosure can be used as a separate underlayment or as an integral part of the artificial turf.

In certain aspects, the reclaimed artificial turf material can comprise a polyolefin, polyamide, polystyrene, polyurethane, polyester, polyvinyl chloride, polyacrylic, or any combination thereof. In certain aspects, the reclaimed artificial turf material comprises a polyolefin. In still further aspects, the polyolefin comprises a polyethylene, polypropylene, or a combination thereof. In still further aspects, the reclaimed artificial turf comprises a polyamide. In some aspects, the polyamide comprises nylon 6, nylon 6,6, nylon 1,6, nylon 12, nylon 6,12, or a combination thereof. In still further aspects, the reclaimed artificial turf comprises a polyester. In such aspects, the polyester comprises polyethylene terephthlate, polypropylene terephthalate, polybutylene terephthlate, or any combination thereof.

In an exemplary synthetic turf construction, the face fibers can make up from about 19 wt % to about 80 wt % of the overall synthetic turf, including exemplary values of about 20 wt %, about 30 wt %, about 40 wt %, about 50 wt %, about 60 wt %, and about 70 wt %. The primary backing material can make up from about 1 wt % to about 25 wt % of a synthetic turf, including exemplary values of about 5 wt %, about 10 wt %, about 15 wt %, and about 20 wt %. The adhesive backing material can make up from about 15 wt % to about 80 wt % of a synthetic turf, including exemplary values of about 20 wt %, about 30 wt %, about 40 wt %, about 50 wt %, about 60 wt %, and about 70 wt %.

The face fibers may include any material that is conventionally used in carpet manufacture, singly or in combination with other such materials. For example, the face fibers can be synthetic, such as, for example a material comprising one or more of a conventional nylon, polyester, polypropylene (PP), polyethylene (PE), polyurethane (PU), polyvinyl chloride (PVC), polyethylene terephthalate (PET), polypropylene terephthalate (PPT), polybutylene terephthalate (PBT), polytrimethylene terephthalate (PTT), latex, styrene butadiene rubber, or any combination thereof. It is contemplated that the conventional nylon of the face fibers can be, for example and without limitation, nylon 6/6, nylon 6, nylon 10, nylon 10/10, nylon 10/11, nylon 11, and the like. Additionally, the face fibers can comprise natural fibers, such as cotton, wool, or jute. In exemplary aspects, the face fibers can comprise one or more biodegradable materials, including, for example and without limitation, polylactic acid (PLA).

In exemplary aspects, the face fibers may include from about 0 wt % to about 100 wt % polyethylene, from about 0 wt % to about 100 wt % polypropylene, and from about 0 wt % to about 100 wt % nylon. In some aspects, the face fibers include blends of polypropylene (PP) and polyethylene (PE) in any of the following ratios of PP:PE—5:95; 10:90; 50:50; 90:10; 95:5, or any ratio that is within these ranges of ratios. In some aspects, the face fibers include blends of PP and nylon in any of the following ratios of PP:nylon—5:95; 10:90; 50:50; 90:10; 95:5, or any ratio that is within these ranges of ratios. In some aspects, the face fibers include blends of PE and nylon in any of the following ratios of PE:nylon—5:95; 10:90; 50:50; 90:10; 95:5, or any ratio that is within these ranges of ratios. In some aspects, the face fibers include blends of PP, PE, and nylon in any of the following ratios of PP:PE:nylon—10:10:80; 10:80:10; 80:10:10; 33:33:33, or any ratio that is within these ranges of ratios.

The primary backing may include any material that is conventionally used in carpet manufacture, singly or in combination with other such materials. For example, the primary backing can be synthetic, such as, for example a material comprising one or more of a conventional nylon, polyester, polypropylene (PP), polyethylene (PE), polyurethane (PU), polyvinyl chloride (PVC), polyethylene terephthalate (PET), polypropylene terephthalate (PPT), polytrimethylene terephthalate (PTT), polybutylene terephthlate (PBT), latex, styrene butadiene rubber, or any combination thereof. It is contemplated that the conventional nylon of the primary backing can be, for example and without limitation, nylon 6/6, nylon 6, nylon 10, nylon 10/10, nylon 10/11, nylon 11, and the like. Additionally, the primary backing can comprise natural fibers, such as cotton, wool, or jute. In exemplary aspects, the primary backing can comprise one or more biodegradable materials, including, for example and without limitation, polylactic acid (PLA).

In exemplary aspects, the primary backing may include from about 0 wt % to about 100 wt % polyester or from about 0 wt % to about 100 wt % polypropylene. Thus, in these aspects, it is contemplated that the primary backing may include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % of polyester. It is further contemplated that the primary backing may include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % of polypropylene. In some aspects, the primary backing includes blends of PP and polyester in any of the following ratios of PP: polyester—5:95; 10:90; 50:50; 90:10; 95:5, or any ratio that is within these ranges of ratios.

The adhesive backing can include polyurethane, latex, hot melt adhesive, and/or thermoplastics alone or in combination. Suitable hot melt adhesives include, but are not limited to, Reynolds 54-041, Reynolds 54-854, DHM 4124 (The Reynolds Company P.O. Greenville, S.C., DHM Adhesives, Inc. Calhoun, Ga.). Suitable thermoplastics include, but are not limited to polypropylene, polyethylene and polyester. The adhesive backing can also include a filler such as coal fly ash, calcium carbonate, iron oxide, or barium sulfate, or any other filler known in the art. The adhesive backing can include from about 0 wt % to about 100 wt % polyurethane, from about 0 wt % to about 100 wt % latex, from about 0 wt % to about 100 wt % hot melt adhesive, and/or from about 0 wt % to about 100 wt % thermoplastic. Thus, the adhesive backing can include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % of polyurethane. It is further contemplated that the adhesive backing can include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % latex. It is further contemplated that the adhesive backing can include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % hot melt adhesive. It is still further contemplated that the adhesive backing can include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, at least 75 wt %, at least 80 wt %, at least 85 wt %, at least 90 wt %, or at least 95 wt % thermoplastic polymer. The adhesive backing can include from about 0 wt % to about 80 wt % filler. Thus, the adhesive backing can include at least 5 wt %, at least 10 wt %, at least 15 wt %, at least 20 wt %, at least 25 wt %, at least 30 wt %, at least 35 wt %, at least 40 wt %, at least 45 wt %, at least 50 wt %, at least 55 wt %, at least 60 wt %, at least 65 wt %, at least 70 wt %, or at least 75 wt % filler. In some aspects, the adhesive backing includes polyurethane, latex, or thermoplastic and from about 20 wt % to about 80 wt % filler, or from about 40 wt % to about 60 wt % filler. In other aspects, the adhesive backing includes a blend of a hot melt component and from greater than 0 wt % to about 50 wt % filler, including for example, from about 1 wt % to about 25 wt % filler.

Synthetic turf may also include an infill material dispersed among the upstanding ribbons, which acts as a ballast and/or contributes to the physical properties of the turf, such as resiliency, that make the turf suitable for a particular use. Synthetic turf infill may be made of any material suitable for providing desired physical properties for the synthetic turf, but most often includes materials such as sand, gravel, cork, polymer beads, and rubbers, including but not limited to crumb rubber, ethylene propylene diene monomer (EPDM) rubber, and neoprene rubber. In still further aspects, the turf infill can also comprise at least one of silica sand, rubber crumb granules, organic component, ethylene propylene diene monomer (EPDM) rubber, thermoplastic elastomers, polyurethane or any combination thereof.

In certain aspects, the pad is further comprised of an artificial turf infill material 112 (FIGS. 23-28) embedded within the composite nonwoven pad. In such aspects, the disclosed pads can comprise reclaimed carpet materials that comprise an amount greater than 0 wt % of one or more of an artificial turf infill, a silica sand, a rubber granule, an organic component, ethylene propylene diene monomer (EPDM) rubber, thermoplastic elastomers, polyurethane, a dirt, natural soils, or a combination thereof. In yet other aspects, the reclaimed materials used in the disclosed pad comprise about 0.05 wt %, about 0.1 wt %, about 0.5 wt %, about 1 wt %, about 2 wt %, about 3 wt %, about 4 wt %, about 5 wt %, about 10 wt %, about 15 wt %, about 20 wt %, or about 30 wt % of one or more of an artificial turf infill, a silica sand, a rubber granule, an organic component, ethylene propylene diene monomer (EPDM) rubber, thermoplastic elastomers, polyurethane, a dirt, or a combination thereof.

In addition to fibrous reclaimed carpet material described above, it should be appreciated that reclaimed carpet material and reclaimed synthetic turf material can further comprise one or more impurities. For example, representative impurities that can be present include dirt, sand, oil, inorganic filler, and other conventionally known waste materials that can be present in reclaimed carpet or synthetic turf material.

In yet other aspects, the reclaimed artificial turf material used in the inventive pads can comprise a thermoset polymer, a thermoplastic polymer, or a combination thereof.

In certain aspects, the disclosed pad can comprise the at least one reclaimed artificial turf material in any desired amount. In some exemplary aspects, the at least one reclaimed artificial turf material can be present in the pad in an amount in the range of from greater than 0% to 100% by weight of the resulting pad, including exemplary amounts of about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, and about 95% by weight, as well as any amounts falling within ranges derived from these listed exemplary amounts. In still further aspects, the at least one reclaimed artificial turf material can be present in an amount within any range derived from the above values, including for example, an amount in the range of from greater than 0% by weight to 90% by weight, from 30% by weight to 70% by weight, or from 40% by weight to 60% by weight.

In yet other aspects, the pads disclosed herein can comprise at least one performance additive 114 (FIGS. 24-28) embedded within the nonwoven blend. The at least one performance additive used herein can comprise any known in the art recycled materials or virgin materials. In yet other aspects, the at least one performance additive can comprise a virgin polymer material, high denier fibers, low melt fibers, a resilient material, foam chips, rubber chips, cork, wood chops, silica sand, adhesive material, binder fibers, or any combinations thereof. It is understood that unless specifically identified, any of these materials can have a virgin or a recycled origin. It is further understood that any of the mentioned materials can undergo multiple recycling cycles prior to the use in the disclosed pads.

In still further aspects, the fibers present as the at least one performance additive can comprise a fiber having a denier from about 3 to 50, including exemplary values of about 5 denier per filament (DPF), about 8 denier per filament (DPF) about 10 denier per filament (DPF), about 12 denier per filament (DPF), about 15 denier per filament (DPF), about 20 denier per filament (DPF), about 25 denier per filament (DPF), about 30 denier per filament (DPF), about 35 denier per filament (DPF), about 40 denier per filament (DPF), and about 45 denier per filament (DPF). In yet other aspects, the high denier fiber comprises a fiber from about 50 denier per filament (DPF) to about 500 denier per filament (DPF), including exemplary values of about 100 denier per filament (DPF), about 150 denier per filament (DPF), about 200 denier per filament (DPF), about 250 denier per filament (DPF), about 300 denier per filament (DPF), about 350 denier per filament (DPF), about 400 denier per filament (DPF), and about 450 denier per filament (DPF). In yet other aspects, the fibers present in the disclosed pad can have a uniform denier value. In yet still other aspects, the fibers can have a large variety of denier values that falls within any of the above-mentioned values. In yet other aspects, the low melt fiber disclosed herein can have a denier from about 3 to 15 denier per filament (DPF). It is understood that as used herein, low melt fibers define fibers having a melting point between about 100° C. and about 180° C. In certain aspects, the melting point of the low melt fiber is about 110° C., about 120° C., about 130° C., about 140° C., about 150° C., about 160° C., or about 170° C.

In yet other aspects, the low melt material can also be present in the reclaimed carpet material. In some exemplary aspects, polypropylene, when present in the reclaimed carpet fibers, can be beneficially used as low-melt content for fusing surrounding higher melt fibers together.

In still other aspects, the low melt fibers used as the at least one performance additive can be obtained from one or more manufacturers, such as Wellman, Inc., Fiber Innovations, Inc., Huvis Corp., Tuntex Textile Co., Ltd., Stein, Inc., Reliance Industries, Ltd., and Teijin, Ltd.

In yet other aspects, the low melt fibers that are present as the at least one performance additive can comprise, for example and without limitation, a low-melt polyester, polypropylene, polyethylene, copolyester, copolymer nylons, engineered olefins, conjugate filament-linear low-density polyethylene, acrylics, low-melt nylon, and the like. As one having ordinary skill in the pertinent art will appreciate, the heating of a low-melt fiber in a disclosed pad can create globules of low-melt polymer at crossover points where the low-melt fibers intersect with higher-melt fibers.

In still further aspects, the at least one performance additive comprising the low-melt material can comprise glycol-modified polyethylene terephthalate (PETG). In yet other aspects, the at least one performance additive comprising the low-melt fiber can comprise an elastomeric low-melt fiber, including, for example and without limitation, ethylene vinyl acetate (EVA), thermoplastic elastomers (TPE), thermoplastic rubbers, thermoplastic olefins, and the like. As one having ordinary skill in the pertinent art will appreciate, the heating and re-curing of elastomeric low-melt fibers can create stretchable crossover points where the elastomeric low-melt fibers intersect with higher-melt fibers, thereby improving the load-bearing capabilities of the fiber pad.

In yet other aspects, the at least one performance additive comprising the low-melt fiber can comprise a bi-component fiber having a portion of high- or standard-melt material and a portion of low-melt polymer. In such aspects, the bi-component fiber configuration can be, for example and without limitation, islands-in-the-sea, side-by-side, core-sheath, and the like. As one having ordinary skill in the pertinent art will appreciate, bi-component fibers can maintain their original structural integrity while also allowing each fiber to glue itself to adjacent fibers. As one having ordinary skill in the pertinent art will further appreciate, the use of bi-component fibers increases the amount and strength of bonding between adjacent fibers due to the increased length of axial contact between the fibers. It is contemplated that any known materials having appropriate melt characteristics can be used to form the bi-component fibers.

In yet other aspects, the at least one performance additive comprising the low-melt material can comprise a low-melt powder, flake, or granule. It is contemplated that any of the above-referenced materials can be provided in a powder, flake, or granule form. In one aspect, scattering machines can be used to evenly disperse the low-melt powders, flakes, and granules throughout the pad. Manufacturers of these conventional scattering machines include TechnoPartner Samtronic, Technoboard, Caritec, and Schott Meissner.

In some aspects, the desired amount of the low-melt material can range from about 0% to about 80% of the total amount of material present within the disclosed pad, including exemplary values of about 5%, about 10%, about 20%, about 30%, about 40%, about 50%, about 60%, and about 70%. In yet other aspects, the low-melt material can be present in any amount between any foregoing values. For example, the low-melt material can be present from about 5% to about 60% of the total amount of material in the pad, or from about 10% to about 40% of the total amount of material in disclosed pad. It is contemplated that the at least one low-melt material can have any denier that is appropriate for a particular application, including any denier ranging from about 1 to about 1,500 denier per filament. For example, the at least one low-melt material can have any denier ranging from about 1 to about 1,500 denier per filament, including exemplary values of about 5 denier per filament, about 10 denier per filament, about 20 denier per filament, about 50 denier per filament, about 100 denier per filament, about 200 denier per filament, about 300 denier per filament, about 400 denier per filament, about 500 denier per filament, about 600 denier per filament, about 700 denier per filament, about 800 denier per filament, about 900 denier per filament, about 1,000 denier per filament, about 1,100 denier per filament, about 1,200 denier per filament, about 1,300 denier per filament, and about 1,400 denier per filament.

In yet other aspects, the at least one performance additive can comprise a resilient material. In certain aspects, the resilient material comprise one or more of ethylene-propylene-diene monomer rubber (EPDM), ethylene-propylene monomer rubber (EPM), acrylonitrile-butadiene (NBR), styrene-butadiene (SBR), carboxylated NBR, carboxylated SBR, styrene block copolymer, thermoplastic elastomer, flexible very low density polyethylene resins, or a combination thereof.

In still further aspects, the heat set binder present in the disclosed pad comprises a low-melt fiber. In yet other aspects, the heat set binder is a low-melt binder. In still further aspects, the low-melt fiber present as the heat set binder can be any low-melt fiber disclosed above. In still further aspects, the heat set binder can comprise any of the low-melt fibers disclosed above. In yet other aspects, the heat set binder can comprise a low-melt powder. In still further aspects, heat set binder can comprise a bi-component low melt binder.

In still further aspects, the nonwoven blend further comprises at least one reclaimed carpet material. As disclosed herein, the reclaimed carpet material can comprise a post-consumer carpet material, a post-industrial carpet material, or a combination thereof. It is understood that the at least one reclaimed carpet material present in the disclosed pad can comprise any material that is conventionally used in a carpet manufacture. For example, the at least one reclaimed carpet material can be synthetic, such as, for example a material comprising one or more of a conventional nylon, polyester, polypropylene (PP), polyethylene (PE), polyurethane (PU), polyvinyl chloride (PVC), polyethylene terephthalate (PET), polytrimethylene terephthalate (PTT), latex, polyacrylic, styrene butadiene rubber, or any combination thereof. It is contemplated that the conventional nylon of the reclaimed carpet material can be, for example and without limitation, nylon 6/6, nylon 6, nylon 10, nylon 10/10, nylon 10/11, nylon 11, and the like. Additionally, the reclaimed carpet material can comprise natural fibers, such as cotton, wool, or jute. In exemplary aspects, the reclaimed carpet material can comprise one or more biodegradable materials, including, for example and without limitation, polylactic acid (PLA). According to aspects of the invention, a reclaimed carpet material comprising synthetic and/or natural materials described above can optionally be present as a reclaimed carpet fiber. Any one or more of the above disclosed materials can be obtained from various component parts of the prior manufactured carpet product, for example and without limitation, a reclaimed carpet material can be obtained from a face layer, an adhesive layer, a backing layer, a secondary backing layer, an underlayment, a cushioning material, a reinforcing layer, or a scrim, or any combination thereof.

Additionally, the reclaimed carpet material can also comprise fillers. The fillers can be any suitable filler, including, for example, aluminum oxide trihydrate (alumina), calcium carbonate, barium sulfate or mixtures thereof. The fillers can be virgin filler, waste material, or even reclaimed fillers. Examples of recycled fillers include coal fly ash and calcium carbonate. In the aspects wherein the reclaimed carpet material comprises an artificial turf, the reclaimed material can also comprise an amount of infill materials commonly used in the turf. In such exemplary aspects, the reclaimed material can comprise an amount of silica sand, rubber granules, organic components, dirt, any combination thereof, and the like.

The reclaimed carpet material can be obtained from a variety of sources. In one example, the reclaimed carpet material can be obtained from a collection site. Approximately 50 collection sites are positioned throughout the United States. These collection sites take in a post-consumer carpet which is then shipped to a facility for sorting according to a fiber type. Once sorted, a baled material of primarily the same or similar fiber type is then shipped to a secondary location where various techniques are employed for reducing the large pieces of carpet to small chunks or shredded fiber and to provide an amalgamated mixture. The amalgamated mixture will typically contain face fibers, a primary backing, a secondary backing, a carpet binder and, in some cases, an attached cushion. After this stage, the product can be used with or without further refinement or processing to remove additional contaminates. In some aspects, the reclaimed carpet material can be obtained directly from the site, bypassing a collection site.

For use in connection with various aspects of the present invention and, dependent on the end use and desired cost of the product, reclaimed carpet material can comprise a relatively coarse blend of ground or shredded post-consumer carpet (PCC) or a more refined less coarse material containing primarily opened carpet face fibers. According to some aspects, the reclaimed carpet material can, for example, comprise relatively coarse slit tape fibers derived from reclaimed primary and secondary backing materials. The coarse material is able to provide a low-cost structural material that can serve as reinforcement for the pad products described herein. In some aspects, additional processing steps can be desirable. For example, the post-consumer carpet material can be further chopped or sheared into any desired size, including for example, fiber or tape yarn lengths in the range of from about 1/64 inch to about 3 inches.

According to certain aspects, the fibrous material present within the reclaimed carpet material exhibits a substantially uniform size, including substantially uniform liner density measured in denier units and substantially uniform fiber lengths. However, in alternative aspects, fibers present within the reclaimed carpet material can have non-uniform linear densities and non-uniform fiber lengths. According to these aspects, a population of reclaimed carpet fibers having non-uniform linear fiber densities can, for example, have individual linear fiber densities in the range of from about 1 to about 1,500 denier per filament (DPF), including exemplary values of about 1 to about 1,500 denier per filament, including exemplary values of about 5 denier per filament, about 10 denier per filament, about 20 denier per filament, about 50 denier per filament, about 100 denier per filament, about 200 denier per filament, about 300 denier per filament, about 400 denier per filament, about 500 denier per filament, about 600 denier per filament, about 700 denier per filament, about 800 denier per filament, about 900 denier per filament, about 1,000 denier per filament, about 1,100 denier per filament, about 1,200 denier per filament, about 1,300 denier per filament, and about 1,400 denier per filament. Still further, a population of reclaimed carpet fibers having non-uniform linear density can collectively provide an average linear fiber density that is, for example, greater than 1 DPF, greater than 10 DPF, greater than 50 DPF, greater than 100 DPF, greater than 500 DPF, greater than 1,000 DPF, or even greater than 1,500 DPF.

In addition to fibrous reclaimed carpet material described above, it should be appreciated that reclaimed carpet material can further comprise one or more impurities. For example, representative impurities that can be present in reclaimed carpet material, and thus, present in the pads described herein include dirt, sand, oil, inorganic filler, and other conventionally known waste materials that can be present in reclaimed carpet material.

In yet other aspects, the reclaimed carpet material used in the inventive pads can comprise a thermoset polymer, a thermoplastic polymer, or a combination thereof.

In still further aspects, the reclaimed carpet material comprises a polyolefin, polyamide, polystyrene, polyurethane, polyester, polyacrylic, polyvinyl chloride, or any combination thereof. In yet other aspects, the polyolefin present in any part of the reclaimed carpet material comprises any of the mentioned above polyolefins. In certain aspects, the polyolefin comprises a polyethylene, polypropylene, or a combination thereof. It is understood that the polyamide present in any part of the reclaimed carpet material comprises any of the mentioned above polyamides. In certain aspects, the polyamide comprises nylon 6, nylon 6,6, nylon 1,6, nylon 12, nylon 6,12, or a combination thereof. In still further aspects, it is understood that the polyester present in any part of the reclaimed carpet material comprises any of the mentioned above polyesters. In some exemplary aspects, the polyester comprises polyethylene terephthalate, polypropylene terephthalate, polybutylene terephthlate, or any combination thereof. In yet further aspects, the reclaimed carpet material can comprise crosslinked styrene-butadiene copolymer, a crosslinked ethylene vinyl acetate copolymer, or a combination thereof. It is understood that the disclosed pad can use one or more materials originated from the reclaimed carpet materials. It is further understood that the materials originated from the reclaimed carpet material do not have to be chemically similar to be used in the inventive pad.

In certain aspects, the disclosed pad can comprise the reclaimed carpet material in any amount. In some exemplary aspects, the reclaimed carpet material can be present in the pad in an amount in the range of from greater than 0% to 100% by weight of the resulting pad, including exemplary amounts of about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, and about 95% by weight, as well as any amounts falling within ranges derived from these listed exemplary amounts. In still further aspects, the reclaimed carpet material can be present in an amount within any range derived from the above values, including for example, an amount in the range of from greater than 0% by weight to 90% by weight, from 30% by weight to 70% by weight, or from 40% by weight to 60% by weight.

In yet other aspects, the shock pad disclosed herein can further comprise a reinforcing scrim 116 (FIGS. 25A and 25B) adhered to one of the face surface or back surface. In some aspects, the scrim comprises a non-woven fiberglass, a wet-laid fiberglass, a non-woven thermoplastic fabric, a woven thermoplastic fiber, or a combination thereof. In certain aspects, the reinforcing scrim is permeable on the top. In still further aspects, the reinforcing scrim is permeable at the bottom. In still further aspects, the reinforcing scrim is impermeable at the bottom. In yet other aspects, the reinforcing scrim is permeable on the top and permeable on the bottom. In still further aspects, the reinforcing scrim is permeable on the top and impermeable at the bottom. In the aspects where the reinforcing scrim is impermeable at the bottom the disclosed pad can enhance drainage in a lateral direction. In still further aspects, a polyethylene extruded sheet can be applied to the bottom of the pad to seal the pad. In yet other aspects, any other film or an impermeable spray-coat can be applied to the bottom of the pad. It should be understood that any of the aforementioned means for sealing the bottom of the pad can also provide a separation layer that enhances lateral drainage of the pad as described in more detail below. In certain aspects, the scrim can behave as a visual enhancement. In yet other aspects, the scrim can help to ensure pad's impermeability. In certain aspects, the heat and pressure applied to the pad seals the pad construction. In yet other aspects, the polyethylene film applied to the bottom of the pad can form an impermeable feature that can, for example, be suitable for use as a geotextile membrane.

In still further aspects, the shock pad further comprises a polymer film 120 (FIG. 27) adhered to the back surface of the nonwoven pad. In yet other aspects, the polymer film comprises a thermoplastic material. In yet other aspects, the polymer film is a thermoplastic film. In other aspects, the polymer film comprises polymers and copolymers of polyethylene, polypropylene, polyurethane, polyester, polyvinylchloride, nylon and polyethylene vinyl acetate. In yet other aspects, the polymer film comprises polyethylene, polypropylene, polyurethane, polyester, polyvinyl butyral, or polyvinylchloride, or a combination thereof. In a yet further aspect, the polymer film is polyethylene. In yet further aspects, the polymer film is a combination of polyethylene and polyester.

In some aspects, the polymer film disclosed herein is a fluid barrier. In yet other aspects, the polymer film is fluid impermeable. In still further aspects, the polymer film is substantially impermeable. In yet other aspects, the polymer film is semipermeable material. In certain aspect, the polymer film is impermeable or substantially impermeable to gases and/or fluids. In one aspect, the polymer film is impermeable (or substantially impermeable) to aqueous fluids. In another aspect, the polymer film is impermeable (or substantially impermeable) to non-aqueous fluids. In further exemplary aspects, the polymer film is impermeable (or substantially impermeable) to water, human or pet bodily fluids, food fluids, food processing fluids, rain, or snow. In yet other aspects, the polymer film is a moisture barrier film. In some aspects, the moisture barrier film is adhered to the back surface of the nonwoven pad.

In certain aspects, the polymer film disclosed herein is an extruded film. In yet other aspects, the polymer film disclosed herein is a blown film. In a yet further aspect, the polymer film is a cast film. In a still further aspect, the polymer film is an engineered film. The term "engineered film" as used herein refers to a polymer film comprising same or different polymers and copolymers, wherein the film is formed by various techniques to ensure desirable properties. In some aspects, the engineered film is a reinforced film. In some aspects, and without limitation, the engineered reinforced film can comprise a plurality of layers of the same or different polymer or copolymer. In other aspects, the engineered film can comprise layers of polyethylene film sandwiched with a layer of polyester. In yet further aspects, the engineered film can comprise layers of polyethylene and polypropylene, or layers of polyethylene and chemically resistant ethylene vinyl alcohol (EVOH) copolymer. In certain aspects, the engineered film used in the current disclosure can be purchased from Raven Industries, P&O Packaging, Mid-South Extrusion, or Direct Packaging.

As disclosed herein, in some aspects, the polymer film can have a thickness of less than about 6 mils. In other aspects, the polymer film can have a thickness of exemplary values of about 5.5 mils, about 5 mils, about 4.5 mils, about 4 mils, about 3.5 mils, about 3 mils, about 2.5 mils, about 2 mils, about 1.5 mils, about 1 mil, and about 0.5 mils. In other aspects, the polymer film can have a thickness in any range derived from any two of the above stated values. For example, and without limitation the polymer film can have thickness from about 1 mil to about 5.5 mils, or from about 2 mils to about 4 mils, or from about 1 mil to about 3.5 mils.

In some other aspect, the polymer film can have a thickness of greater than about 10 mils. In other aspects, the polymer film can have a thickness of exemplary values of about 10 mils, about 15 mils, about 20 mils, about 25 mils, about 30 mils, about 35 mils, about 40 mils, about 45 mils, about 50 mils, about 55 mil, about 60 mils, about 65 mils, about 70 mils, about 75 mils, about 80 mils, about 85 mils, about 90 mils, and about 100 mils. In other aspects, the polymer film can have a thickness in any range derived from any two of the above stated values. For example, and without limitation the polymer film can have thickness from about 10 mils to about 40 mils, or from about 30 mils to about 50 mils, or from about 30 mil to about 80 mils.

In some aspects, the polymer film used herein is continuous. In other aspects, the polymer film is substantially free of perforations or pinholes. In yet other aspects, the polymer film is continuous and substantially free of perforations.

In still further aspects, the composite nonwoven pad can have a thickness extending between the face surface and the opposed back surface in the range of from about 0.10 inches to about 7 inches, including exemplary values of about 0.5 inch, about 1 inch, about 2 inch, about 3 inch, about 4 inch, about 5 inch, and about 6 inch. In yet other aspects, the thickness can be in the range between any foregoing values. For example, the thickness pad can be from about 0.15 inches to about 2 inches, from about 0.20 inches to about 1 inch, or from about 0.5 inch to about 5 inch.

In other aspects, the pad can have any width. In certain aspects, the width is in the range of from about 5 inch to about 250 inch, including exemplary values of about 10 inch, about 20 inch, about 30 inch, about 40 inch, about 50 inch, about 60 inch, about 70 inch, about 80 inch, about 90 inch, about 100 inch, about 110 inch, about 120 inch, about 130 inch, about 140 inch, about 150 inch, about 160 inch, about 170 inch, about 180 inch, about 190 inch, about 200 inch, about 210 inch, about 220 inch, about 230 inch, and about 240 inch. In yet other aspects, the width can be in the range between any foregoing values. For example, the width can be from about 5 inch to about 150 inch, about 20 inches to about 200 inches, or from about 50 inch to about 100 inch.

In yet further aspects, the shock absorbing pads described herein can have any desired density. In some exemplary aspects, the pad can have any desired density in the range of from about 0.5 to about 30 lbs/ft$^3$, including exemplary values of about 1 lbs/ft$^3$, about 2 lbs/ft$^3$, about 3 lbs/ft$^3$, about 4 lbs/ft$^3$, about 5 lbs/ft$^3$, about 6 lbs/ft$^3$, about 7 lbs/ft$^3$, about 8 lbs/ft$^3$, about 9 lbs/ft$^3$, about 10 lbs/ft$^3$, about 11 lbs/ft$^3$, about 12 lbs/ft$^3$, about 13 lbs/ft$^3$, about 14 lbs/ft$^3$, about 15 lbs/ft$^3$, about 16 lbs/ft$^3$, about 17 lbs/ft$^3$, about 18 lbs/ft$^3$, about 19 lbs/ft$^3$, about 20 lbs/ft$^3$, about 21 lbs/ft$^3$, about 22 lbs/ft$^3$, about 23 lbs/ft$^3$, about 24 lbs/ft$^3$, about 25 lbs/ft$^3$, about 26 lbs/ft$^3$, about 27 lbs/ft$^3$, about 28 lbs/ft$^3$, and about 29 lbs/ft$^3$. In yet other aspects, the pad can have a density value between any two foregoing values. For example, the pad can have a density value in the range from about 2 lbs/ft$^3$ to about 30 lbs/ft$^3$, or from 10 lbs/ft$^3$ to about 20 lbs/ft$^3$.

In yet other aspects, the pad disclosed herein can have regions or portions of varying densities. For example, the pad can comprise a first portion having a first density and a second portion having a second density different from the first density. In some aspects, the first portion of the pad is adjacent to the face surface. In other aspects, the second portion of the pad is adjacent to the opposed back surface. In certain aspects, the first density is larger than the second density. In still other aspects, the first density is lower than the second density. In certain aspects, the varying densities of the pad can be obtained by any known in the art methods. In yet some aspects, varying density can be achieved by applying needling methods.

In still further aspects, optionally and without limitations, the pad can comprise any desired amount of spray-on binder liquids, including, for example and without limitation, acrylics, water-dispersed thermoplastics, cross-linked thermosets, polyurethanes, polymerizable compounds, and the like. As one having ordinary skill in the pertinent art will appreciate, upon exposure to elevated temperatures, these binders can cross-link, polymerize, and drive off water or solvents. As one having ordinary skill in the pertinent art will further appreciate, after exposure of the binders to elevated temperatures, residual portions of the binders can bond adjacent fibers together to improve the dimensional stability of the pad. It is contemplated that these binders can be applied to the pad using any spray-on techniques as are conventionally used in the pertinent art.

In still further aspects, a turf system that incorporates inventive pads as described herein can exhibit Gmax values of less than about 200 g's as measured according to ASTM F-355. This ASTM standard test consists of a guide tube of about 2.5 feet tall, and a 20-pound cylindrical weight that falls through the tube. An accelerometer mounted on the weight measures how rapidly the missile decelerates or stops. The flat-faced "missile" is connected to a velocity measuring device that records the velocity as the missile hits the surface and the G-forces that are experienced during decelerations. In still further aspects, when the shock pad is present as a component in an artificial turf system, the artificial turf system can exhibit a Gmax value less than about 165 g's as measured according to ASTM F-355. In yet other aspects, when the shock pad is present as a component in an artificial turf system, the artificial turf system can exhibit Gmax values less than about 195 g's, less than about 190 g's, less than about 185 g's, less than about 180 g's, less than about 175 g's, less than about 170 g's, less than about 165 g's, less than about 160 g's, less than about 155 g's, less than about 150 g's or less than about 145 g's. Such turf system can comprise the inventive pads, turf, and optionally, infill material.

In still further aspects, a turf system that incorporates exemplary pads can exhibit Gmax value of less than 165 g's as measured according to Synthetic Turf Council Guidelines (STC), including exemplary values of less than about 160 g's, less than about 155 g's, less than about 150 g's and less than about 145 g's.

In still further aspects, a turf system incorporating pads described herein can exhibit the Head Injury Criterion (HIC) test values of equal to or less than about 1,000, less than about 900, less than about 800, less than about 700, or less than about 600. As one of ordinary skill in the art would readily appreciate, the "Head Injury Criterion" Test, or HIC Test, is the internationally recognized measure for the likelihood of head injury.

As cited in Ratte, D. J. ((1990) "Development of Human Factors Criteria For Playground Equipment Safety." Silver Spring, Md.: COMSIS Corporation), the Head Injury Criteria (HIC) is an alternate interpretation of the 1970 Wayne State Tolerance Curve (WSTC) (King and Ball, 1989). As Ratter states, the portion of the impact pulse covered by the HIC was intended to taking into account the rate of load application, which is thought to be critical in determining soft tissue injury (Committee on Trauma Research, 1985; Goldsmith and Ommaya, 1984.) Per Ratte, an HIC value of 1,000 is taken as the concussion tolerance threshold and is currently used by the US Department of Transportation as the standard for evaluating head injury and testing safety systems (e.g. restraint systems) in the context of vehicular collisions.

In certain aspects, the HIC impact test uses a Triax 2010 device that allows measuring the force of a human head when it strikes a playing surface. By following the protocol established by the American Standard for Testing Materials for the F355-16 E-Missile the probability and severity of a head injury can be determined. The HIC Impact Test drops a 9.9 lb. hemisphere projectile (curved like a human head) from increasing heights and measures the impact. It is understood that the higher Critical Fall Height, the safer the surface. The disclosed pad when present as a component in an artificial turf system, results in the turf system that can produce a minimum Critical Fall Height of about 1.3 m to about 1.7 m. In some exemplary aspects, Rugby Federation Standard (International Rugby Board (IRB) standard) requires the turf to meet the standard of 1,000 HIC from 1.3 m.

In yet other aspects, the HIC impact can be measured according to European Standard DIN EN1177 at 23° C. or 40° C. to show the HIC equal to or less than 1,000 at fall height of about 1.0 m to about 1.3 m. In still further aspects, a turf system that incorporates inventive pads as described herein can exhibit the Head Injury Criterion (HIC) test values measured according to European Standard DIN EN1177 at 23° C. or 40° C. to show the HIC less than about 900, less than about 800, less than about 700, or less than about 600.

In a further aspect, the shock absorbing pads of the instant disclosure exhibit excellent compression set values. Products with high compression set will generally leave noticeable, long-term indentations. In particular aspects of the present invention, the compression set of the pads described herein can be from about 1 to about 40%, where the % refers to the % recovery of the pad. The compression is measured according to ASTM D3676 and ASTM D3574 standards. The methods require stacking a number of 2"×2" specimens to obtain about 1 inch of thickness, this thickness is recorded as an initial thickness $T_1$. The sample, then, is pressured and compressed to 50% of its original thickness. The compressed specimen is placed into the air circulating oven at 158° F. (+/−2° F.) for 22 hours (+/−0.5 hour). After the samples are removed from the air circulating oven, the sample are given to recover at 73° F. (+/−4° F.) and 50% (+/−5%) relative humidity atmosphere from either 30 min (ASTM D3574) or 4-5 hours (ASTM D3676). The thickness $T_2$ has been measured by end of the recovering step and compression set as a % of thickness loss was calculated according to $$C_s = \frac{T_1 - T_2}{100} \times 100.$$

Still further, the compression set of the pads is from about 1, 2, 3, 4, 5, 6, 7, 8, 9, 10, 11, 12, 13, 14, 15, 16, 17, 18, 19, 20, 21, 22, 23, 24, 25, 26, 26, 28, 29, or 30%, where compression set is measured in accordance with the parameters herein, and where any value can form an upper or a lower endpoint as appropriate.

In still further aspects, the shock absorbing pads of the instant disclosure exhibit excellent compression resistance values. The compression resistance is measured according to ASTM D3676 standard. This method evaluates the load required to compress sample to some predetermined amount of its original thickness. It is used as an indicator of how well a shock absorbing pad resists "bottoming out" under a given load. Typical compression resistance is measured at 25% and 65% of compression. In these aspects, the compression resistance for 25% and 65% corresponded to a load of 5.37 lb and 149.27 lb respectively. In this test method 2"×2" specimens are stacked to obtain about 1 inch of thickness, conditioned to equilibrium at 50% (+/−5%) relative humidity and at 73° F. (+/−4° F.), and then compressed to 25% or 65% with a press. The compression resistance is measured according to:

$$C_r = \frac{A(\text{force in pounds, lbs})}{B(\text{area, in sq. inch})}.$$

The max compression recovery can be from about 1 to about 30%, including exemplary values of about 2, 3, 4, 5, 6, 7, 8, 9, 10, 11, 12, 13, 14, 15, 16, 17, 18, 19, 20, 21, 22, 23, 24, 25, 26, 26, 28, and 29. In yet other aspects, the compression recovery can be from about 1 to about 95% after 48 hours, including exemplary aspects of about 2, 3, 4, 5, 6, 7, 8, 9, 10, 11, 12, 13, 14, 15, 16, 17, 18, 19, 20, 21, 22, 23, 24, 25, 26, 26, 28, 29, 30, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 833, 84, 85, 86, 87, 88, 89, 90, 91, 92, 93, and about 94% as measured according to ISO 3416-1986 standard.

In yet other aspects, the friction of the pad can be measured on both sides as measured according to the ASTM C1028 standard or according to the ASTM D1894. The ASTM C1028 is used to measure the static coefficient of friction for flooring surfaces such as carpet, ceramic tile, laminate, and wood under both wet and dry conditions while utilizing Neolite Heel Assemblies. The test can be used in the laboratory or on the field. The static coefficient of friction is measured as the ratio of the horizontal component to force applied to a body to overcome the friction or resistance to slipping to the vertical component of the weight of the object or force applied to it.

Figure 26:
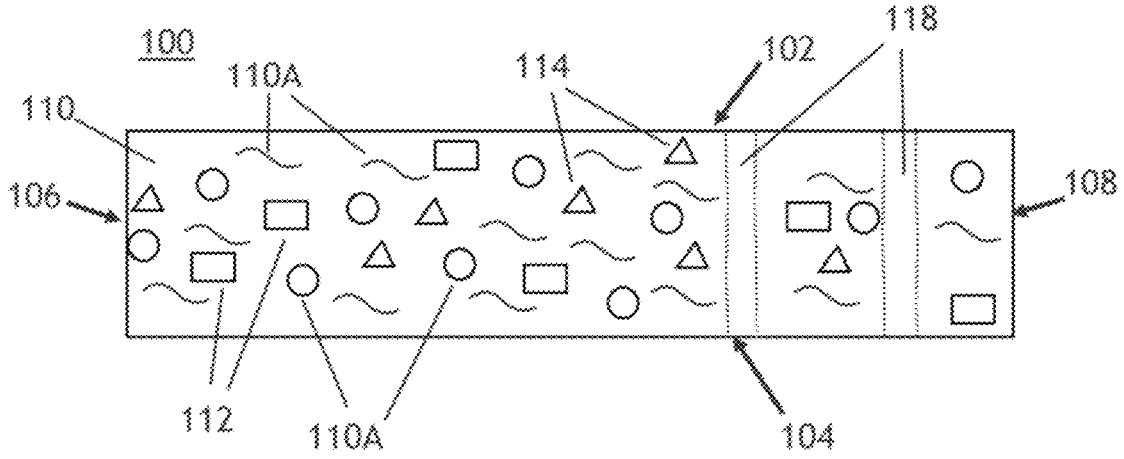
FIG. 26 depicts a schematic representation of an exemplary pad according to aspects of the present invention.
Figure 27:
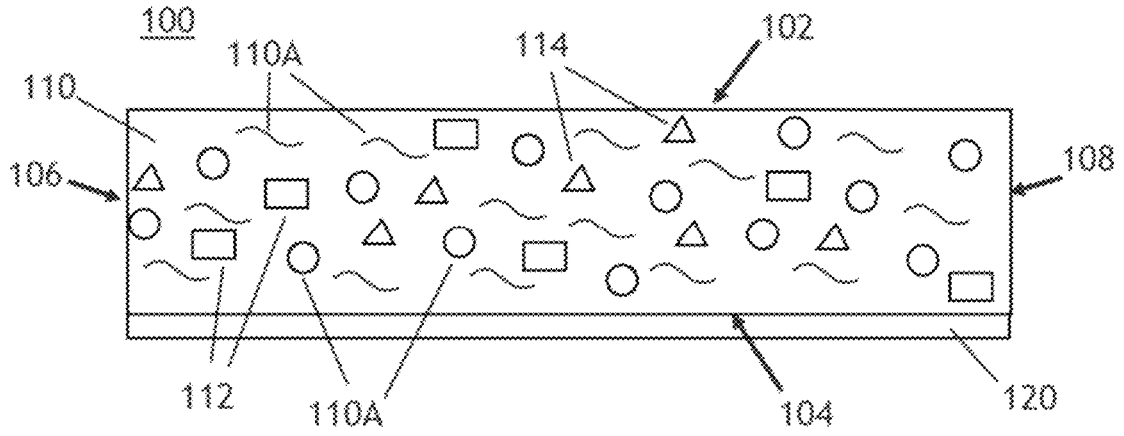
FIG. 27 depicts a schematic representation of an exemplary pad according to aspects of the present invention.

In still further aspects, the shock pad disclosed herein can exhibit beneficial drainage characteristics. This drainage can be in a vertical direction, a lateral or horizontal direction, or a combination of both. In some aspects, either the face or back surface can be profiled to provide pathways for drainage. For example, the nonwoven pad can be configured such that it defines a plurality of channels extending from the face surface to the opposed back surface 118 (FIG. 26). In certain aspects, each channel of the plurality of channels has a first outer periphery on the face surface and a second outer periphery on the opposite back surface. In other aspects, the first and second outer peripheries define a diameter of the channel. In still further aspects, the each channel of the plurality of channels is spaced apart along the length and/or width of the nonwoven pad. It is understood that the each channel of the plurality of channels is in a fluid communication with the face and the opposite back surfaces of the pad providing a path for vertical drainage. In still further aspects, the nonwoven construction can also provide permeability to the pad.

In yet other aspects, a plurality of channels can be configured in either the face or back surface extending laterally along a surface to provide enhanced lateral or horizontal drainage. Still further, a separation layer can be present as noted above. This too can enhance lateral drainage toward the edges of the shock pad rather than draining through the pad from one face to another. The horizontal drainage can be used to define a hydraulic transmissivity of the disclosed pads.

In certain aspects, the plurality of channels can be circular in cross-section, or can have any of various other cross-sectional shapes, including but is not limited to elliptical shape, oval shape, polygonal shape, star like shape, and like. In certain aspects, each of the plurality of channels can have a diameter from about 1 mm to about 15 mm, including exemplary values of about 2 mm, about 3 mm, about 4 mm, about 5 mm, about 6 mm, about 7 mm, about 8 mm, about 9 mm, about 10 mm, about 11 mm, about 12 mm, about 13 mm, and about 14 mm. It is further understood that each of the plurality of the channels can have any diameter between any foregoing values.

Yet in other aspects, the plurality of channels present in the shock absorbing pad have a percent open area from about 1% to about 10% based on 1 $m^2$ of the pad, including exemplary values of about 2%, about 3%, about 4%, about 5%, about 6%, about 7%, about 8%, and about 9% based on 1 $m^2$ of the pad.

In certain aspects, the disclosed pad can provide a free flowing vertical drainage system. The drainage can be measured according to ASTM D3385 standard. In some aspects, the vertical drainage can accommodate up from about 10 in/h to about 7,000 in/h of fluid flow, including exemplary values of about 50 in/h, about 100 in/h, about 500 in/h, about 1,000 in/h, about 2,000 in/h, about 3,000 in/h, about 4,000 in/h, about 5,000 in/h, and about 6,000 in/h. In yet other aspects, the vertical drainage can accommodate any water flow between the two foregoing values. The vertical drainage can be used to define the permeability of the disclosed pads.

In still further aspects, the second outer periphery of the plurality of channels on the opposed back surface opens to the polymer film attached to the back surface of the nonwoven pad. In such aspects, polymer film provides a plane for a lateral drainage of the fluid conveyed by the plurality of channels. In yet other aspects, the disclosed pad comprising a polymer film can provide a free flowing lateral drainage system. In some aspects, the lateral drainage can accommodate up from about 5 in/h to about 5,000 in/h of fluid flow, including exemplary values of about 10 in/h, about 20 in/h, about 50 in/h, about 100 in/h, about 500 in/h, about 1,000 in/h, about 2,000 in/h, about 3,000 in/h, and about 4,000 in/h. In yet other aspects, the lateral drainage can accommodate any water flow between the two foregoing values.

Figure 28:
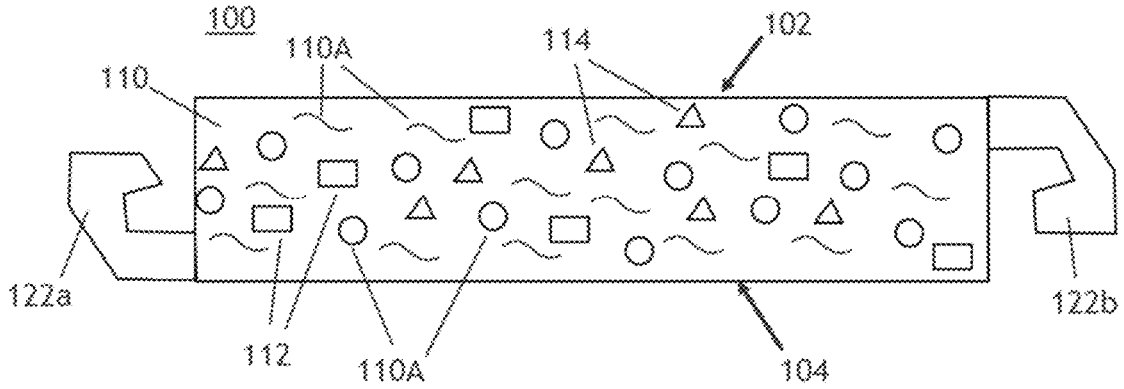
FIG. 28 depicts a schematic representation of an exemplary pad according to aspects of the present invention.
Figure 29:
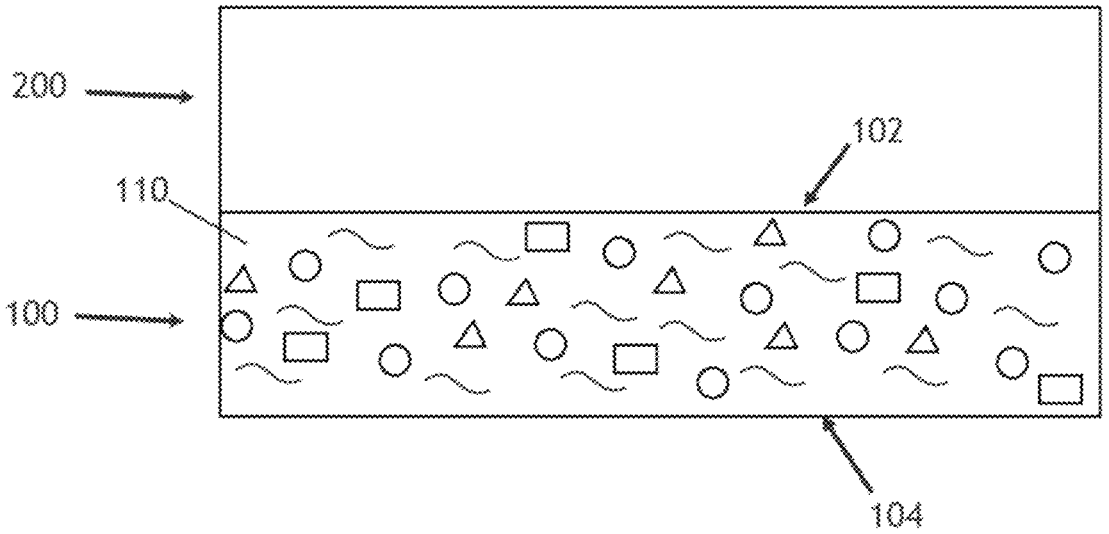
FIG. 29 depicts a schematic representation of an exemplary turf system according to aspects of the present invention.

In yet further aspects, disclosed herein is the composite nonwoven pad further comprising opposing first and second side edges 106 and 108 (FIGS. 22-27), and wherein the plurality of side edges define an edge locking structure. The disclosed pads can be installed to provide a plurality of adjacent shock absorbing pads in any selected orientation. Each of the plurality of adjacent shock absorbing pads comprises the composite nonwoven pad comprising a plurality of side edges extending between the opposed top and bottom surfaces, wherein the plurality of side edges define an edge locking structure. It is understood that the interlocking structures can be any structures known in the art and defined herein. In certain aspects, the opposing first and second side edges can comprise optional tongue/grove features 122*a* and 122*b* (FIG. 28)

In still further aspects, the composite nonwoven pad can be provided in any form known in the art. In some aspects, the composite nonwoven pad has a continuous length and is rolled into a roll. In such aspects, the roll is unrolled on installation site. In other aspects, the composite nonwoven pad can be provided in a slab form. In such aspects, the pad form a plurality of adjacent shock pads present in interlocking installation. In still further aspects, the face and opposed back surface of the composite nonwoven pad disclosed herein is substantially horizontal.

It is understood that in some aspects, the pad disclosed herein can be used as an underlayment for an indoor artificial turf. In still further aspects, the pad disclosed herein can be used as an underlayment for an indoor artificial turf, an outdoor artificial turf, or a combination thereof. In yet other aspects, the pad disclosed herein can be useful in construction of a soccer, baseball, hockey, lacrosse, gym floor, football, or a rugby field. It is understood that the pads disclosed herein are recyclable to produce third, or fourth generation products. In fact, it is further understood that the pad disclosed herein can undergo multiple recycle cycles. As one of ordinary skill in the art would readily appreciate such versatility of the disclosed pads make these pads very attractive for use in the industry due to their cradle-to-cradle (C2C) design.

An Artificial Turf System

Figure 2:
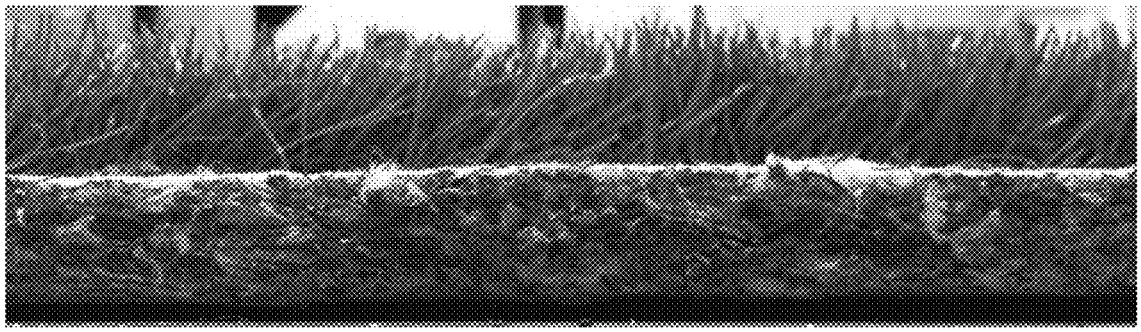
FIG. 2 depicts a photograph of an exemplary pad under artificial turf according to aspects of the present invention.

Also disclosed herein is an artificial turf system comprising: a) an artificial turf comprising a primary backing layer having a face side and a back side and a plurality of turf fibers extending through the backing layer such that a face side portion of the turf fibers extends from the face side of the backing layer, and b) a shock absorbing pad as described herein. An exemplary artificial turf system comprising a disclosed pad is shown on FIG. 2 and its schematic representation is shown on FIG. 29.

It is understood that the pad 100 used in the artificial turf system 200 can be any pad disclosed herein. It is further understood that the artificial grass layer of the disclosed system can be any artificial grass layer known in the art and used in the industry. The artificial grass layer can comprise, for example, face fiber material extending from the substrate, the substrate comprising a primary backing material, primary coating material, secondary coating material, secondary backing material, filler, or any combination thereof. The components of the artificial grass layer can be made from any materials known in the art and commonly used in the art of artificial turf. Similarly, the infill layer disposed on the substrate and interspersed between the pile fibers can comprise any infill materials commonly used in the art of artificial turf. It is further understood that any components of the artificial turf system can comprise virgin and recycled materials in any ratio.

Methods

The present disclosure further provides a method of making a shock absorbing pads using reclaimed artificial turf materials and reclaimed carpet materials. This method provides alternative avenues for disposing of reclaimed artificial turf and reclaimed carpet materials in a manner that significantly reduces or can even eliminate the need to send the material to landfill sites.

The method described herein can be used to recycle and reuse any reclaimed artificial turf and reclaimed carpet materials described above, or other synthetic surfaces having chemical make-up similar to carpets or synthetic turfs.

By recycling and incorporating reclaimed artificial turf materials and reclaimed carpet materials into shock absorbing pads, several advantages can be realized. For example, second generation products, such as shock absorbing pads described herein, incorporating the reclaimed material have less of an environmental footprint relative to traditional materials, comprising only virgin materials. In further aspects, the use of reclaimed turf and carpet materials reduces the amount of traditional, often environmentally harmful materials that previously were sent to landfill, while still providing the same or similar level of product performance. Still further, substitution of virgin material with reclaimed turf and carpet materials can reduce the manufacturing costs associated with producing various first generation products.

In certain aspects, disclosed herein is a method of a pad comprising: a) forming a composite blend of at least one reclaimed artificial turf material and a binder material wherein the at least one reclaimed artificial turf material comprises face fibers, primary backing fibers, adhesive backing, or any combination thereof; b) forming the composite blend into a composite web; and c) treating the composite web to set the binder material under conditions effective to provide a composite nonwoven pad. In still further aspects, the step of treating comprises heat treating, pressurizing, calendaring, or a combination thereof.

As disclosed in details above, the at least one reclaimed artificial turf material can comprise any artificial turf materials known in the art. It is understood that the at least one reclaimed artificial turf material can comprise a post-consumer, a post-industrial material or a combination thereof. Likewise, the at least one reclaimed artificial turf material can be obtained from a variety of sources. In one example, the at least one reclaimed artificial turf material can be obtained from a collection site. The collection sites take in a post-consumer carpet/turf, which is then shipped to a facility for sorting by fiber type. Once sorted, baled material of the same fiber type is then shipped to a secondary location where various techniques are employed for reducing the large pieces or fragments of turf to small chunks or shredded fiber to provide an amalgamated mixture. In yet other aspects, the baled reduction of large pieces or fragments of turf to small chunks or shredded fiber to provide an amalgamated mixture can be done at the same collection facilities. It is understood that the steps describes herein can be done at the same or a different location. After this stage, the product can be used with or without further refinement or processing to remove additional contaminates. Alternatively, the reclaimed turf material can be obtained directly from the point of installation as described below. The reclaimed turf material can be also obtained directly from field sites upon turf filed replacement.

In some aspects, the process of reclaiming the artificial turf material can begin at the point of installation or the point of manufacturing if the reclaimed turf material is of a post-industrial origin. In some exemplary aspects, the process of reclamation begins at the point of installation. In such aspects, prior to step a) the at least one reclaimed artificial turf material is collected from an installation point. For a typical sports field, the synthetic turf is commonly installed by unrolling a roll of synthetic turf, such as, for example, a 15 foot wide by 150 foot long roll of turf. A field typically requires multiple rolls, which are laid out on the field side by side and seamed (glued or welded) together to form the field. Once seamed together, infill is then installed. The infill may be one or more of sand, rubber, and/or any other suitable material as previously described above. When a synthetic turf is removed from a point of installation, typically at least a portion of the infill is separated from the turf. The infill can be removed prior to the removal of the turf, at the same time, or even after the turf has been removed. For example, a machine may collect the infill and place it into a container or onto the field. The turf and infill can be removed at the same time by a machine or by hand.

In certain aspects, there is no need to shred the face fibers from the primary backing material after removal of the infill material. It is understood that by eliminating the step of shredding, the process becomes more efficient and economically valuable. In some exemplary aspects, however, after removal of the infill material, the face fibers of the synthetic turf material can optionally be sheared from the primary backing material. As described above, the sheared face fibers will typically comprise polyethylene, polypropylene, nylon, or other materials singly or in combination. In these exemplary aspects, the remaining carcass material, comprised primarily of primary backing, precoat, filler, secondary backing, and residual face fibers can also be collected and shipped for subsequent recycling processes.

In certain aspects, still prior to the step a), the reclaimed carpet material is size reduced. In some aspects, whether the entire turf (including face fibers and backing materials) is removed intact or the face fibers are, optionally, first sheared from the carcass, the recovered turf can optionally be downsized from the initial roll size into smaller sections (e.g., 1 by 1 foot, or 4 ft rolls, or 7.5 ft rolls for ease and efficiency of shipping) that can be accepted by the next processing step in the reclamation process. The downsizing may be accomplished by hand or machine. The machine may be large or small and may, for example, use rotary blades or knifes or any of a variety of different methods known in the art.

Optionally, fines can be removed from the recovered turf using conventional cleaning equipment. The cleaning equipment can comprise, for example and without limitation, step cleaners, willows, cyclone separators, vertical vibrating chutes, horizontal vibratory screeners, multi-aspirators, rotary sifters, condensers and other methods of cleaning. In use, the cleaning equipment uses airflow to pass fibers across one or more screens. The holes in the screens are too small for the fiber to pass through, but large enough for fines and other contamination to pass through when vacuum is applied. Manufacturers of exemplary cleaning equipment include Dell Orco & Villani Srl, Vecoplan, Wilson Knowles and Sons Ltd, Southern Mechatronics, Signal Machine Company Inc, Kice Industries Inc, Sterling Systems Inc, Pallmann GmbH, OMMI SpA, Pierret Industries Sprl, eFactor 3 LLC, Tria S.p.A, WEIMA America Inc, SSI Shredding Systems Inc, Erko-Trützschler GmbH, and LaRoche S A, among others.

It is further understood that in the aspects described herein the at least one reclaimed artificial turf material can comprise face fibers, primary backing, and adhesive backing. It is further understood that in some aspects, the formed composite blend can also comprise an artificial turf infill material. As described in detail above, the artificial turf infill material can comprise at least one of silica sand, rubber crumb granules, organic component, ethylene propylene diene monomer (EPDM) rubber, thermoplastic elastomers, polyurethane or any combination thereof. It is further understood that the reclaimed artificial turf material used herein can comprise a thermoset polymer, a thermoplastic polymer or any combination thereof. In still further aspects, and as disclosed herein the reclaimed artificial turf material can comprise a polyolefin, polyamide, polystyrene, polyurethane, polyester, polyacrylic, polyvinyl chloride, or any combination thereof.

In still further aspects and as described above, the formed composite blend further comprises at least one performance additive. In such aspects, the at least one performance additive comprises a virgin polymeric material, high denier fibers, a low melt fibers, a resilient material, foam chips, rubber chips, cork, wood chips, silica sand, adhesive material, binder fibers, or any combination thereof. It is understood that any performance additive described herein can be utilized to form the composite blend. In certain aspects, in addition to the disclosed above performance additives, other additives such as modifiers, colorants, plasticizers, elastomers, compatibilizers, antimicrobials, and UV stabilizers can be used to form the composite blend. In some exemplary aspects, the modifiers used to form the composite blend can include without limitation wax, EPDM rubber; high and low density polyethylene; or high and low density polypropylene. The use of modifiers or elastomers can further enhance the flex properties. Suitable colorants include dyes and pigments; red, green, blue, black or any number of different colors can be added. However, in some aspects, colorants may have very little effect due to the dark nature of the material.

In still further aspects, the composite blend disclosed herein can comprise at least one reclaimed carpet material. Similarly, to reclaimed artificial turf material, the reclaimed carpet material can comprise any carpet materials known in the art. In some aspects, the reclaimed turf and carpet materials comprise a post-consumer, a post-industrial material or a combination thereof. In still further aspects, the reclaimed carpet material can comprise any material disclosed above. It is understood that any component of the reclaimed carpet material can be used, for example and without limitation, a face layer, an adhesive layer, a precoat layer, a backing layer, a secondary backing layer, an underlayment, a cushioning material, an infill material, or a scrim can be used to form the composite blend.

In still further aspects, the binder used to form the composite blend can be any binder known in the art. In still further aspects, the binder can comprise a low melt fiber disclosed herein. In still further aspects, the binder can comprise a low melt powder. In still further aspects, the binder can comprise bi-component fibers.

In other aspects, the step of forming the composite blend into a composite web can comprise any methods known in the art. In some exemplary aspects, the step can include, but is not limited to, conventional airlaying, cross-lapping, carding, needle punching, or thermoforming technique, or any combination thereof.

In still further aspects, the composite nonwoven pad formed in step c) has a face surface and an opposed back surface. In yet other aspects, methods disclosed herein comprise a step of adding a scrim material. In such aspects, after step c) a reinforcing scrim is adhered to at least one of the face surface or the back surface of the composite nonwoven pad. In still other aspects, the reinforcing scrim is adhered during step c). In such aspect, the reinforcing scrim is adhered to the at least one of the face surface or the back surface simultaneously with the heat setting of the binder.

It is understood that the scrim material can comprises any known in the art materials. In some aspects, the scrim comprises a non-woven fiberglass, a wet-laid fiberglass, a non-woven thermoplastic fabric, a woven thermoplastic fiber, or a combination thereof. In certain aspects, the reinforcing scrim is permeable on the top. In still further aspects, the reinforcing scrim is permeable at the bottom. In still further aspects, the reinforcing scrim is impermeable at the bottom. In yet other aspects, the reinforcing scrim is permeable on the top and permeable on the bottom. In still further aspects, the reinforcing scrim is permeable on the top and impermeable at the bottom. In the aspects where the reinforcing scrim is impermeable at the bottom the disclosed pad behaves as a pad having drainage in a lateral direction. In still further aspects, a polyethylene extruded sheet can be applied to the bottom of the pad to seal the pad. In yet other aspects, any other film or an impermeable spray-coat can be applied to the bottom of the pad.

In still further aspects, the method disclosed herein provides for the pad comprising the nonwoven pad having a thickness and width as described above. In still further aspects, the method disclosed herein provide for the pad having a density from about 0.5 to about 30 lbs/ft$^3$, including exemplary values of about 1 lbs/ft$^3$, about 2 lbs/ft$^3$, about 3 lbs/ft$^3$, about 4 lbs/ft$^3$, about 5 lbs/ft$^3$, about 6 lbs/ft$^3$, about 7 lbs/ft$^3$, about 8 lbs/ft$^3$, about 9 lbs/ft$^3$, about 10 lbs/ft$^3$, about 11 lbs/ft$^3$, about 12 lbs/ft$^3$, about 13 lbs/ft$^3$, about 14 lbs/ft$^3$, about 15 lbs/ft$^3$, about 16 lbs/ft$^3$, about 17 lbs/ft$^3$, about 18 lbs/ft$^3$, about 19 lbs/ft$^3$, about 20 lbs/ft$^3$, about 21 lbs/ft$^3$, about 22 lbs/ft$^3$, about 23 lbs/ft$^3$, about 24 lbs/ft$^3$, about 25 lbs/ft$^3$, about 26 lbs/ft$^3$, about 27 lbs/ft$^3$, about 28 lbs/ft$^3$, and about 29 lbs/ft$^3$. In yet other aspects, the pad can have a density value between any two foregoing values. For example, the pad can have a density value in the range from about 2 lbs/ft$^3$ to about 30 lbs/ft$^3$, or from 10 lbs/ft$^3$ to about 20 lbs/ft$^3$. It is further understood that the methods disclosed herein provides for the pad that can have regions or portions of varying densities as described herein. In still further aspects, the pad can be further compressed to any volume predetermined by one of ordinary skill in the art. In certain aspects, the pad can be compressed to 20%, 30%, 40%, 50%, 60%, 70%, 80%, or 90%. In certain aspects, the pad can be further compressed via calendaring or any other known in the art method to increase material density and rigidity.

In still further aspects, the method disclosed herein provides for a pad that when it is present as a component in a turf system, the resulting turf system can exhibit Gmax and HIC values as disclosed above.

In still further aspects, the method of making the inventive pad further comprises a step of forming a plurality of channels in the composite nonwoven pad, wherein the plurality of channels extends from the face surface to the opposed back surface. In such aspects, each of the plurality of channels has a first outer periphery on the face surface and a second outer periphery on the opposed back surface, wherein the first and second outer periphery define a diameter of the channel, and wherein each channel in the plurality of channels is spaced apart along the length of the nonwoven pad. It is understood that such channels can be made by any methods known in the art. In certain aspect, the methods used to create the channels can comprise laser cutting, ultrasonic caning, water jet cutting, dye currying, embossing with an engraved belt, CNC (computer numerical control) routing, drilling, spiking, and the like.

It is understood that the plurality of channels formed by the disclosed method can be circular in cross-section, or can have any of various other cross-sectional shapes, including but is not limited to elliptical shape, oval shape, polygonal shape, star like shape, and like. In certain aspects, each of the plurality of channels can have a diameter from about 1 mm to about 15 mm, including exemplary values of about 2 mm, about 3 mm, about 4 mm, about 5 mm, about 6 mm, about 7 mm, about 8 mm, about 9 mm, about 10 mm, about 11 mm, about 12 mm, about 13 mm, and about 14 mm. It is further understood that each of the plurality of the channels can have any diameter between any foregoing values.

Yet in other aspects, the plurality of channels present in the shock absorbing pad have a percent open area from about 1% to about 20% based on 1 m$^2$ of the pad, including exemplary values of about 2%, about 3%, about 4%, about 5%, about 6%, about 7%, about 8%, about 9%, about 11%, about 12%, about 13%, about 14%, about 15%, about 16%, about 17%, about 18%, and about 19% based on 1 $m^2$ of the pad.

It is understood that the pad formed by the disclosed methods can have a vertical and/or horizontal drainage that can accommodate any disclosed above value of fluid flow.

In certain aspects, the method further comprises a step of adhering a polymer film to the back surface of the nonwoven pad. In some aspects, the polymer film disclosed herein is a fluid barrier. In yet other aspects, the polymer film is a moisture barrier film. In yet other aspects, the polymer film is fluid impermeable. In still further aspects, the polymer film is substantially impermeable. In yet other aspects, the polymer film is semipermeable material. In certain aspect, the polymer film is impermeable or substantially impermeable to gases and/or fluids. In one aspect, the polymer film is impermeable (or substantially impermeable) to aqueous fluids. In another aspect, the polymer film is impermeable (or substantially impermeable) to non-aqueous fluids. In further exemplary aspects, the polymer film is impermeable (or substantially impermeable) to water, human or pet bodily fluids, food fluids, food processing fluids, rain, or snow.

In yet other aspects, the polymer film disclosed herein can be any polymer film or moisture barrier film disclosed above. In certain aspects, the polymer film disclosed herein is an extruded film. In yet other aspects, the polymer film disclosed herein is a blown film. In a yet further aspect, the polymer film is a cast film. In a still further aspect, the polymer film is an engineered film. The term "engineered film" as used herein refers to a polymer film comprising same or different polymers and copolymers, wherein the film is formed by various techniques to ensure desirable properties. In some aspects, the engineered film is a reinforced film. In some aspects, and without limitation, the engineered reinforced film can comprise a plurality of layers of the same or different polymer or copolymer. In other aspects, the engineered film can comprise layers of polyethylene film sandwiched with a layer of polyester. In yet further aspects, the engineered film can comprise layers of polyethylene and polypropylene, or layers of polyethylene and chemically resistant ethylene vinyl alcohol (EVOH) copolymer. In certain aspects, the engineered film used in the current disclosure can be purchased from Raven Industries.

In some aspects, the polymer film is continuous. In other aspects, the polymer film is substantially free of perforations or pinholes. In yet other aspects, the polymer film is continuous and substantially free of perforations.

In still further aspects, the second outer periphery of the plurality of channels on the back surface opens to the polymer film attached to the back surface of the pad. In such aspects, the polymer film provides a plane for a lateral drainage of the fluid conveyed by the plurality of channels. In yet other aspects, the disclosed pad comprising the polymer film can provide a free flowing lateral drainage system as described above.

In yet further aspects, the method disclosed herein provides for the pad comprising the composite nonwoven pad that comprises opposed first and second side edges and wherein the method further comprises profiling the plurality of side edges to define an edge locking structure. The disclosed pads can be installed to provide a plurality of adjacent shock absorbing pads in any selected orientation. Each of the plurality of adjacent shock absorbing pads comprises a nonwoven pad comprising a plurality of side edges extending between the opposed face and back surfaces, wherein the plurality of side edges define an edge locking structure. It is understood that the interlocking structures can be any comprise any structures known in the art and defined herein.

In still further aspects, the method disclosed herein provides for a pad that can be provided in any form known in the art. In some aspects, the nonwoven pad has a continuous length and is rolled into a roll good. In such aspects, the roll is unrolled on installation site. In other aspects, the nonwoven pad can be provided in a slab form. In such aspects, the pad forms a plurality of adjacent shock pads present in interlocking installation. In still further aspects, the face and opposed back surface of the nonwoven pad disclosed herein is substantially horizontal.

Figure 3A:
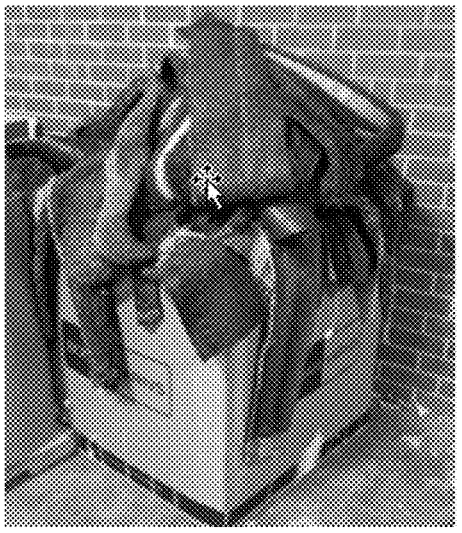
FIGS. 3(*a*)-3(*e*) show photographs depicting exemplary steps of a method of making an exemplary pad according to aspects of the present invention.
Figure 3B:
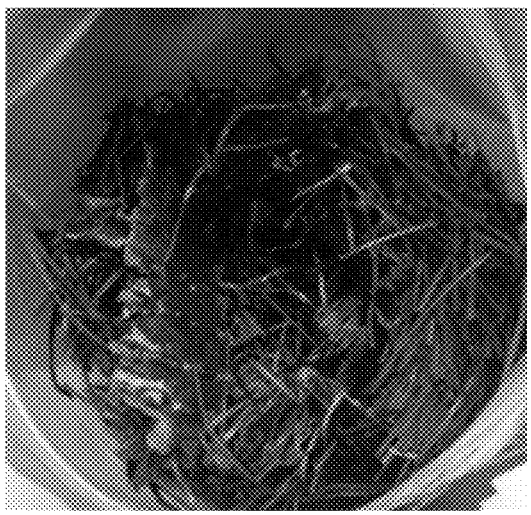
Figure 3C:
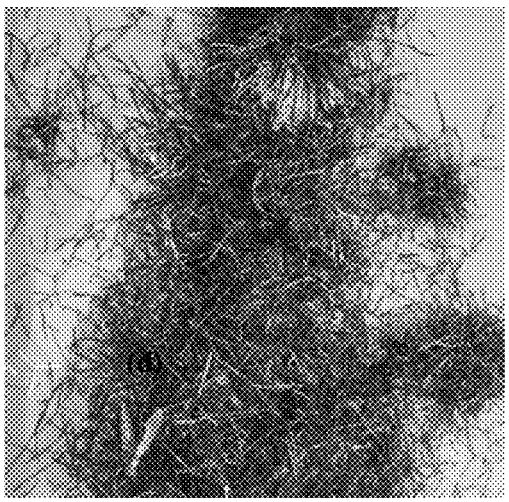
Figure 3D:
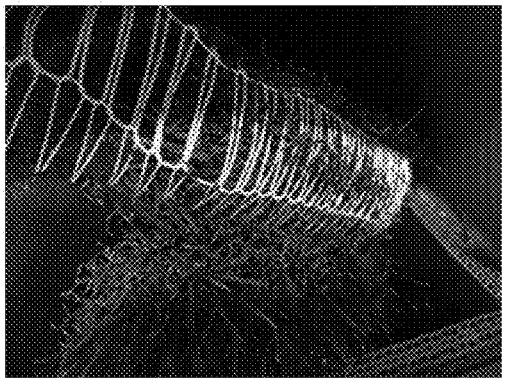
Figure 3:
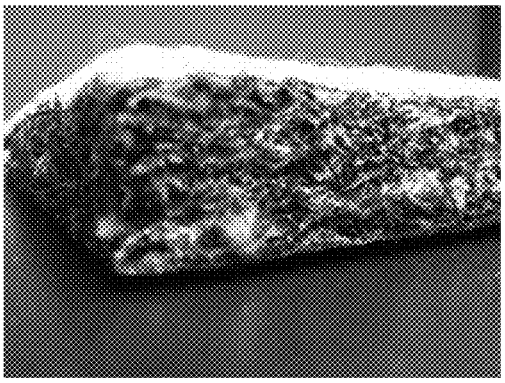

An exemplary process for the manufacture of a recycled shock pad as disclosed herein is illustrated step-wise in FIGS. 3*a* to 3*e*. As shown, the scrap of the post-industrial turf comprising polyurethane coating has been collected (FIG. 3*a*) and shredded (FIG. 3*b*). The shredded scrap is further power separated (FIG. 3*c*) and fed to airlay line (FIG. 3*d*) to form an inventive shock absorbing pad (FIG. 3*e*).

It is understood that in some aspects, the nonwoven pad formed by the methods disclosed herein can be used as an underlayment for an indoor artificial turf. In still further aspects, the pad disclosed herein can be used as an underlayment for an indoor artificial turf, an outdoor artificial turf, or a combination thereof. In yet other aspects, the pad disclosed herein can be useful in construction of a soccer, football, baseball, hockey, lacrosse, gym floors, or a rugby field. It is understood that the pads disclosed herein are recyclable to produce third, or fourth generation products. In fact, it is further understood that the pad disclosed herein can undergo multiple recycle cycles. As one of ordinary skill in the art would readily appreciate such versatility of the disclosed pads make these pads very attractive for use in the industry due to their high cradle-to-cradle (C2C) score. Exemplary calculations of the C2C (cradle-to-cradle) score are shown in Tables 1 and 2.

TABLE 1

Turf attributes (pre pad).

| Average component | Weight (oz) | Total | % | C2C implication |
|---|---|---|---|---|
| Polypropylene (PP) | 8.6 | | 11.58 | recyclable |
| Polyethylene (PE) | 45.0 | 74.3 | 60.52 | recyclable |
| Polyurethane (PU) | 20.7 | | 27.90 | Non-recyclable |

TABLE 2

C2C predicted score.

| | % | x, % | y, % | Alpha, α | Avg. alpha |
|---|---|---|---|---|---|
| Recycled content | 85.00 | 0 | 74 | 50 | 58 |
| Virgin material (PET bi-component) | 15.00 | 0 | 100 | 67 | C2C silver |

Where $x$ = recycled content and $y$-recyclability and $\alpha = \frac{x-2y}{3}$ In connection with any of the inventive aspects described herein, the methods can optionally comprise a sanitization step. As one of skill in the art will appreciate, the presence of impurities in reclaimed turf material can necessitate a need to sanitize the reclaimed materials for health and safety purposes. To that end, the reclaimed turf material can be subjected to a sanitization step at any point during the manufacture of the pad including, sanitizing the reclaimed carpet material prior to its use in the methods described herein or alternatively by sanitizing the reclaimed carpet material after formation of the pad.

EXAMPLES

The following examples are put forth so as to provide those of ordinary skill in the art with a complete disclosure and description of how the compounds, compositions, articles, devices and/or methods claimed herein are made and evaluated, and are intended to be purely exemplary of the invention and are not intended to limit the scope of what the inventors regard as their invention. Efforts have been made to ensure accuracy with respect to numbers (e.g., amounts, temperature, etc.), but some errors and deviations should be accounted for. Unless indicated otherwise, parts are parts by weight, temperature is in ° C. or is at ambient temperature, and pressure is at or near atmospheric.

Example 1

Various samples of comparative shock pads (A-I) and an inventive shock pad (J) as shown in Table 3 were tested. The shock pad performance, when the pad is incorporated into the turf system, is demonstrated below in Table 4.

The inventive pad J comprises a post-industrial turf waste consisting of a face fiber, backing materials and a polyurethane back binding layer. The sample was prepared by opening the turf, first with one cylinder EXCEL, and then with 3 cylinders of CADETTE. The two bi-component fibers were blended in an amount of 4.4 gr (mass of the individual fiber in grams per 9,000 m of fiber)/32 mm of the fiber and 3.3 gr (mass of the individual fiber in grams per 9,000 m of fiber)/32 mm of the fiber (50/50); and then pre-opened on Horizontal opener and one cylinder of EXEL. Both the EXEL and CADETTE are comprised of rotating cylinders. The periphery of the rotating cylinders is covered with metal spikes or card wire with metal teeth resembling saw teeth. The fiber is introduced into the rotating drums at a constant rate and the mechanical action of the drum's exposed sharp points tears the article/fiber and blends the fibers in the same action. The action creates multiple fibers from a textile article. The density of the uncompressed output article is generally much less than input article. It is understood that an open fiber is a fiber that is not matted together but made to be an un-oriented and "fluffy" as compared to the un-opened fibers.

TABLE 3

Samples used in Performance Testing

| Sample | Description |
|---|---|
| A | 7124-A Brock Power Base |
| B | 7124-B Brock SP 14 |
| C | 7124-C Schmitz Foam 23D |
| D | 7124-D Schmitz Foam 16 Eco E |
| E | 7124-E Viconic PU 10 mm |
| F | 7124-F Viconic PP 12 mm |
| G | 7124-G ProGame 5010 XC |
| H | 7124-H ProGame 3008XC |
| I | 7124-I Inka Flex PP |
| J | 7124-L Recycled 17 |

TABLE 4

Initial Performance Testing by SST R&D.

| | | Targeted to pass | | | | | |
|---|---|---|---|---|---|---|---|
| | | <165 | Not defined | <700 | 62-68 | 6-11 | Not defined |
| | | Observation | | | | | |
| Sample | | Gmax | Triax Gmax | Triax HIC | FR % | VD (mm) | ER % |
| A | Top seller brand (high-end) | 78.95 | 110.33 | 412.67 | 68.55 | 10.1 | 27.3 |
| B | Top seller brand | 90.95 | 135 | 496 | 63.8 | 9.2 | 28.1 |
| C | Popular seller | 85.85 | 143.33 | 551 | 64.85 | 10.25 | 30.95 |
| D | Popular seller | 88 | 163 | 653.33 | 62.15 | 9.55 | 31.7 |
| E | Developed with NFL effort | 86.9 | 171.33 | 600 | 67.55 | 9.7 | 20.55 |
| F | PP version of NFL pad | 91.8 | 147 | 502.33 | 60.2 | 8.15 | 26.35 |
| G | | 95.7 | 199.67 | 843.67 | 66.95 | 11.85 | 30.05 |
| H | | 122.5 | 219.33 | 957 | 56.25 | 9.6 | 39.7 |
| I | Popular in Europe, not sold in US | 116.25 | 210 | 870.33 | 56.7 | 8.6 | 29.05 |
| J | Recycled pad | 100.25 | 161.33 | 601.33 | 62.5 | 10.25 | 29.1 |

In the next step, the opened turf in an amount of 85 wt % was blended with 15% of pre-opened bi-component blend; and then, opened again on one EXEL cylinder and airlaid at around 3,800 gsm. The product was run between two scrims into the oven at 145° C.

The recycled pad prepared by the methods of the current invention was further tested to define additional physical properties, such as compression/recovery properties, compression resistance, dimensional stability, etc.

Figure 4:
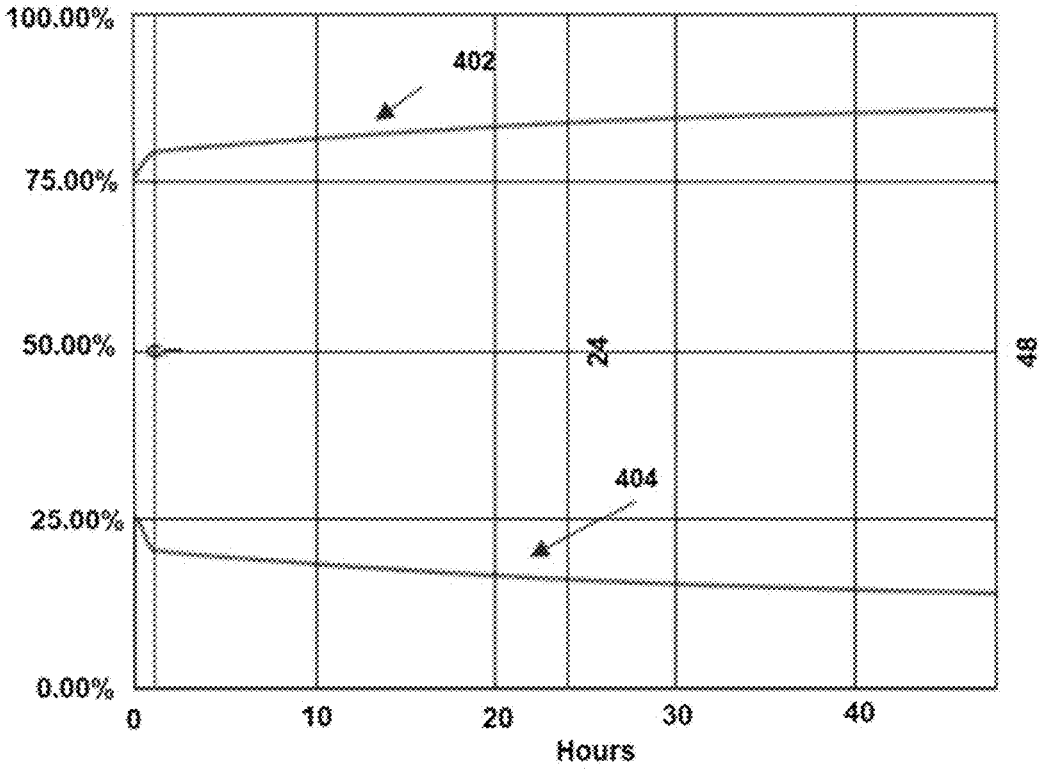
FIG. 4 shows compression recovery properties of an exemplary pad as a function of time.
Figure 5:
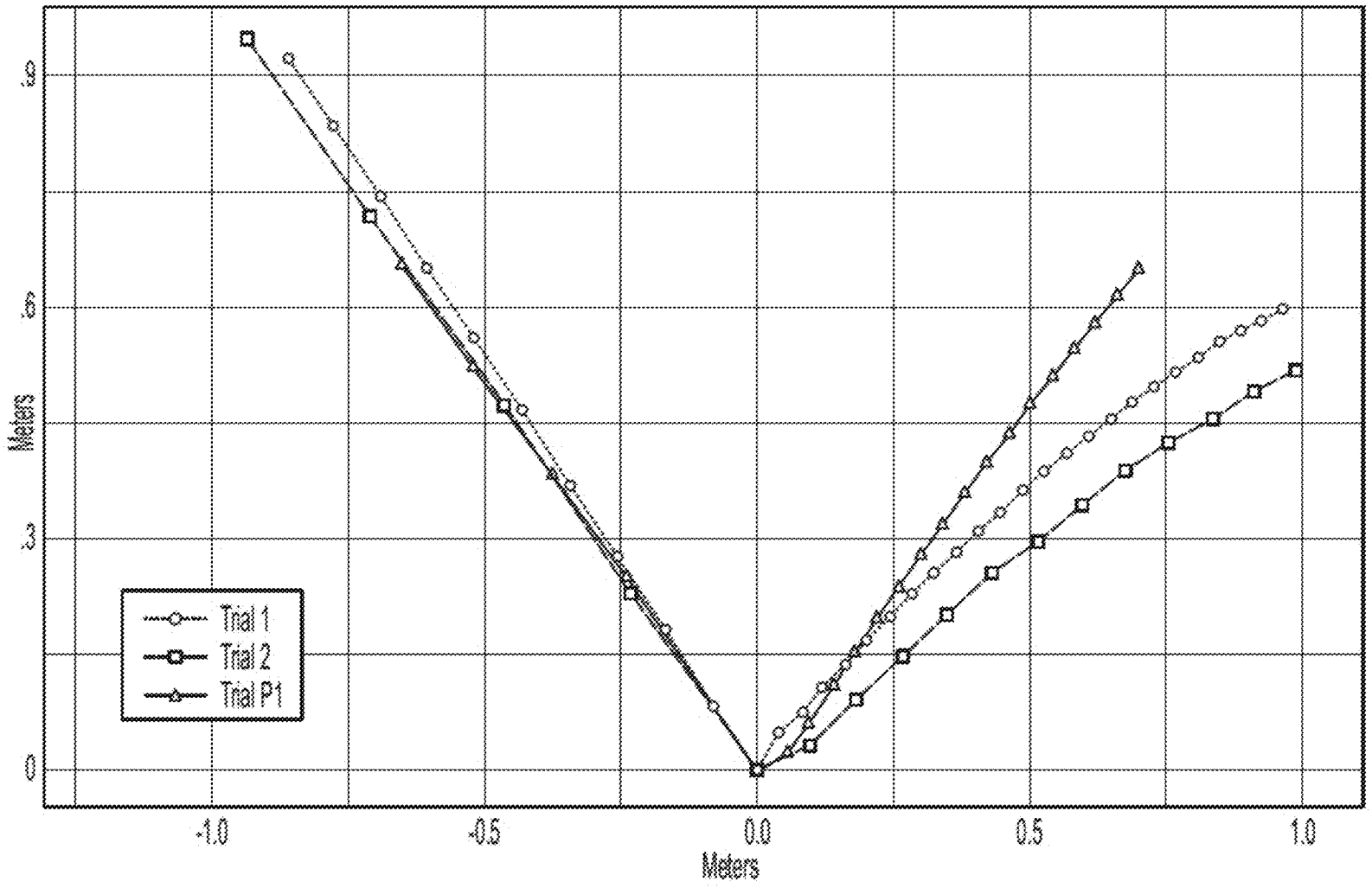
FIG. 5 depicts test results of the baseball bounce off an exemplary field comprising an exemplary pad (Trial P1) according to aspects of the present invention as compared to the baseball bounce off the commercially available artificial fields (Trial 1 and Trial 2).
Figure 6:
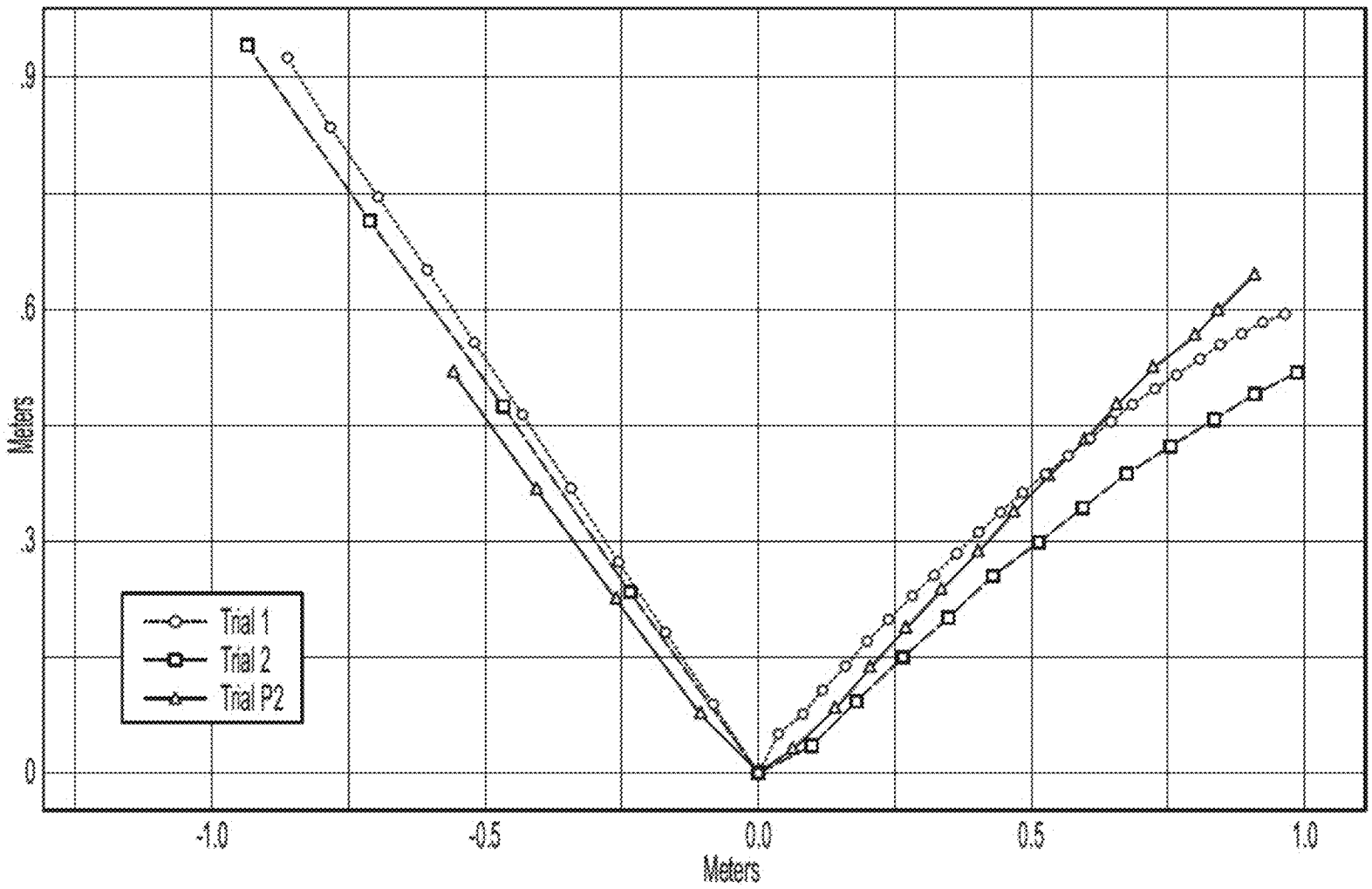
FIG. 6 depicts test results of the baseball bounce off an exemplary field comprising an exemplary pad (Trial P2) according to aspects of the present invention as compared to the baseball bounce off the commercially available artificial fields (Trial 1 and Trial 2).
Figure 7:
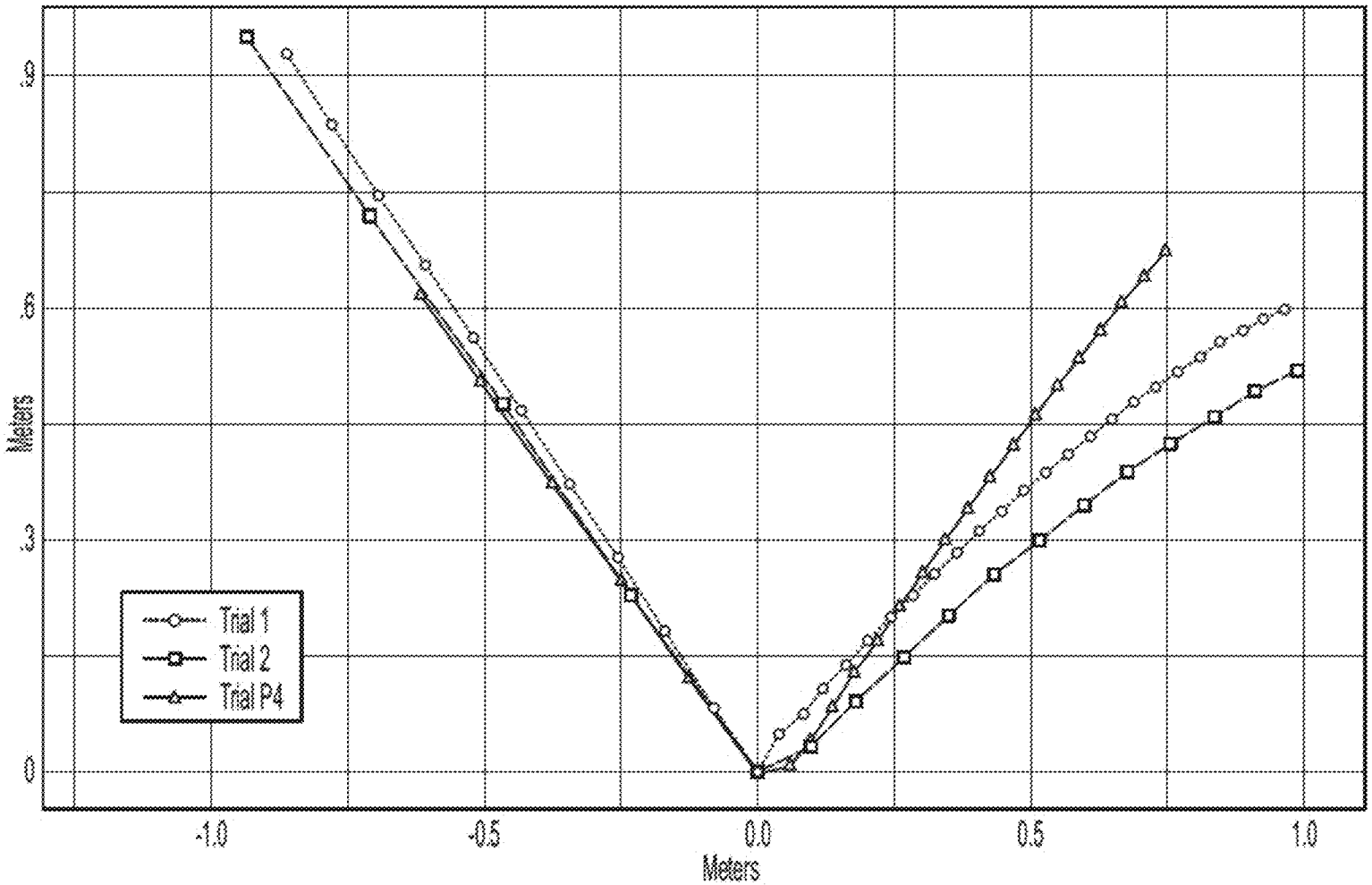
FIG. 7 depicts test results of the baseball bounce off an exemplary field comprising an exemplary pad (Trial P4) according to aspects of the present invention as compared to the baseball bounce off the commercially available artificial fields (Trial 1 and Trial 2).
Figure 8:
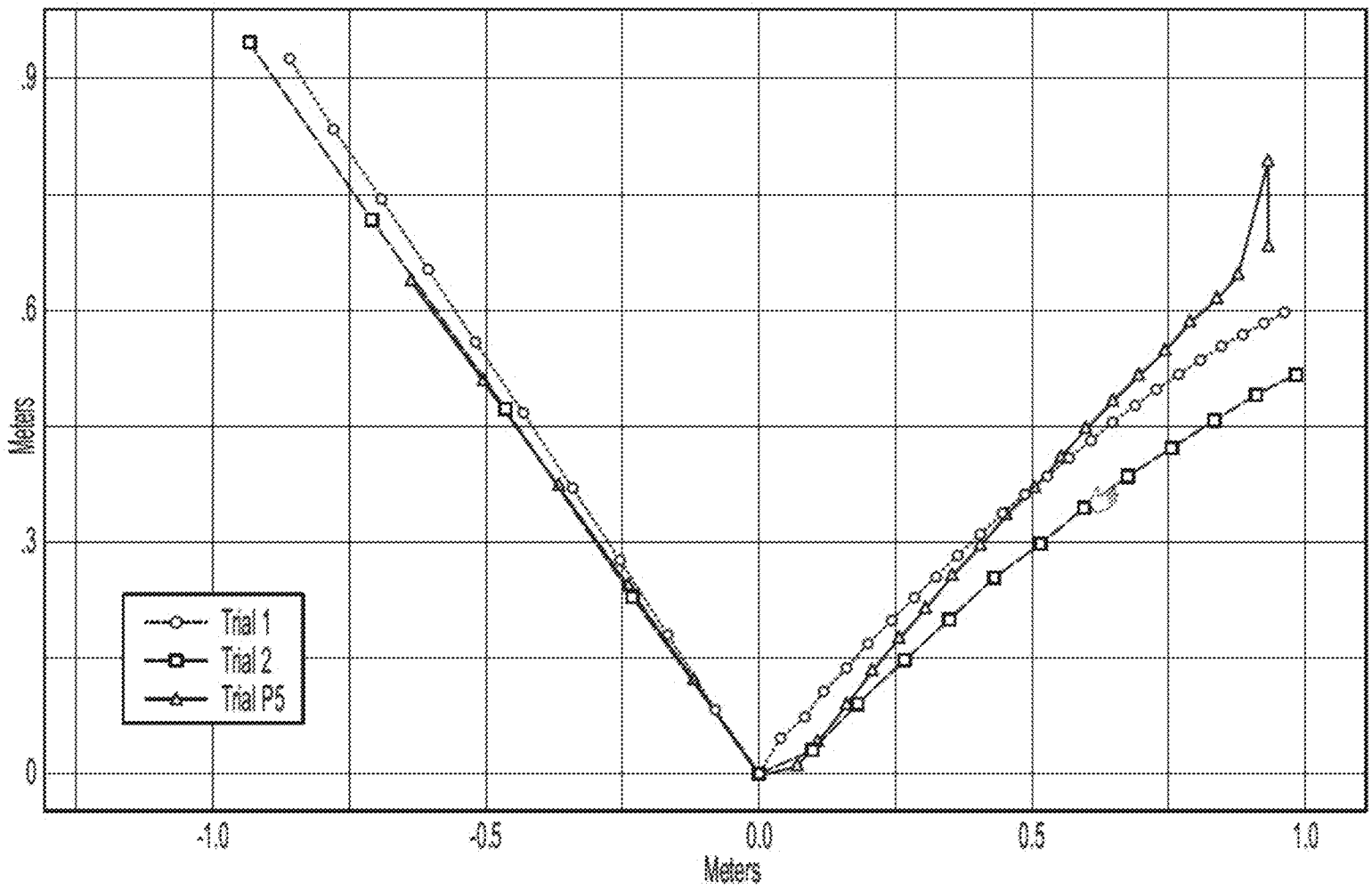
FIG. 8 depicts test results of the baseball bounce off an exemplary field comprising an exemplary pad (Trial P5) according to aspects of the present invention as compared to the baseball bounce off the commercially available artificial fields (Trial 1 and Trial 2).
Figure 9:
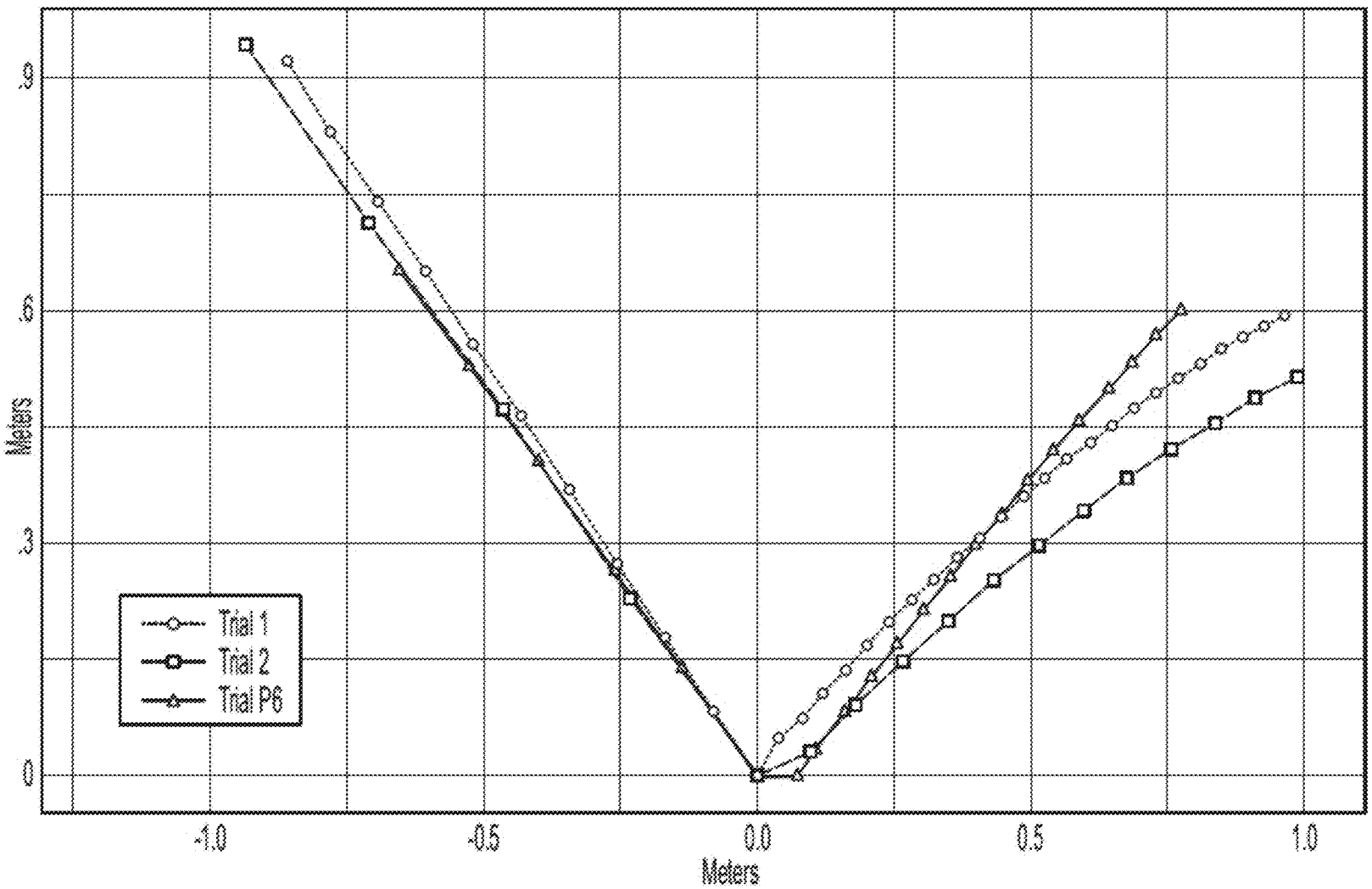
FIG. 9 depicts test results of the baseball bounce off an exemplary field comprising an exemplary pad (Trial P6) according to aspects of the present invention as compared to the baseball bounce off the commercially available artificial fields (Trial 1 and Trial 2).
Figure 10:
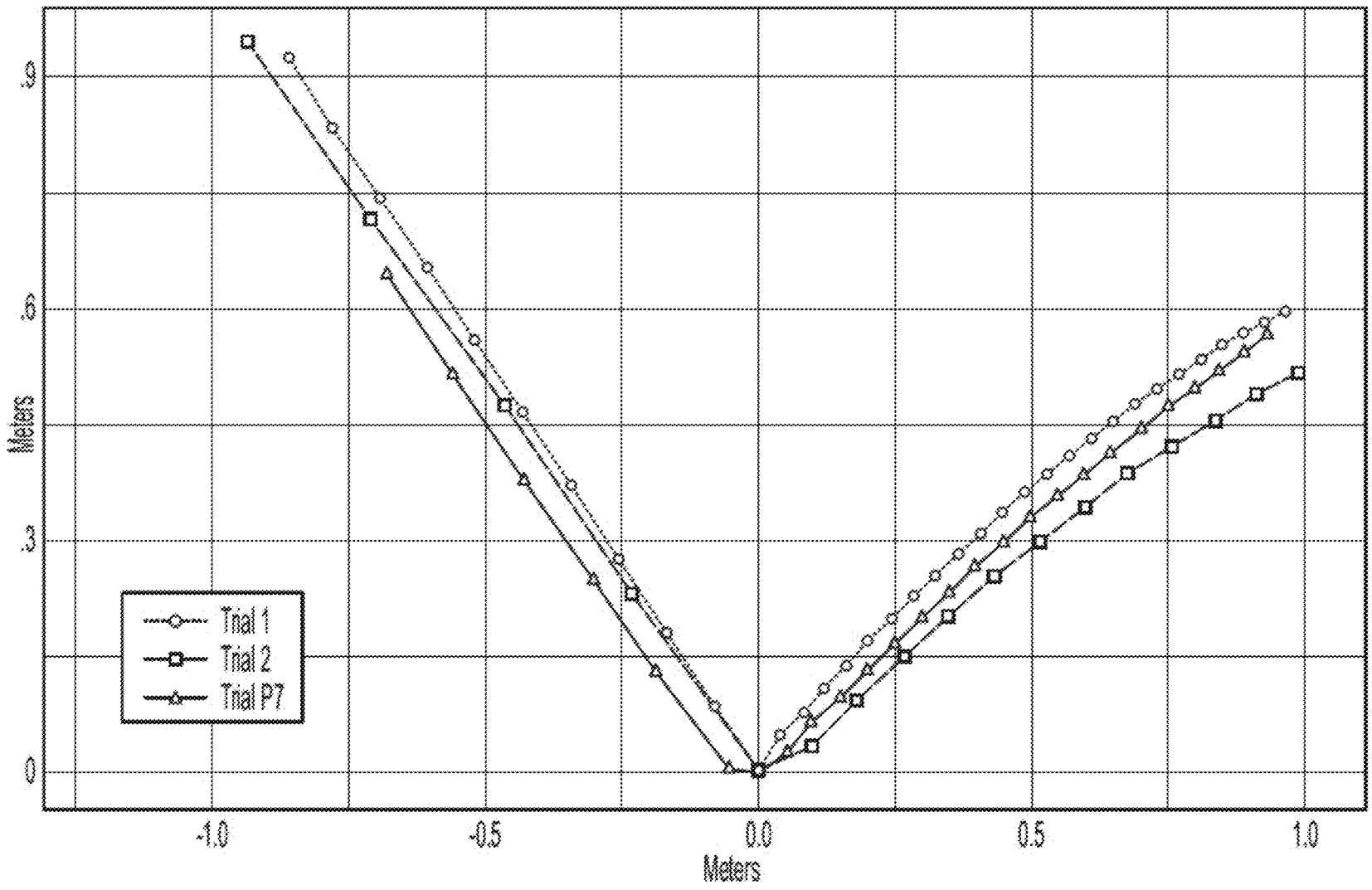
FIG. 10 depicts test results of the baseball bounce off an exemplary field comprising an exemplary pad (Trial P7) according to aspects of the present invention as compared to the baseball bounce off the commercially available artificial fields (Trial 1 and Trial 2).
Figure 11:
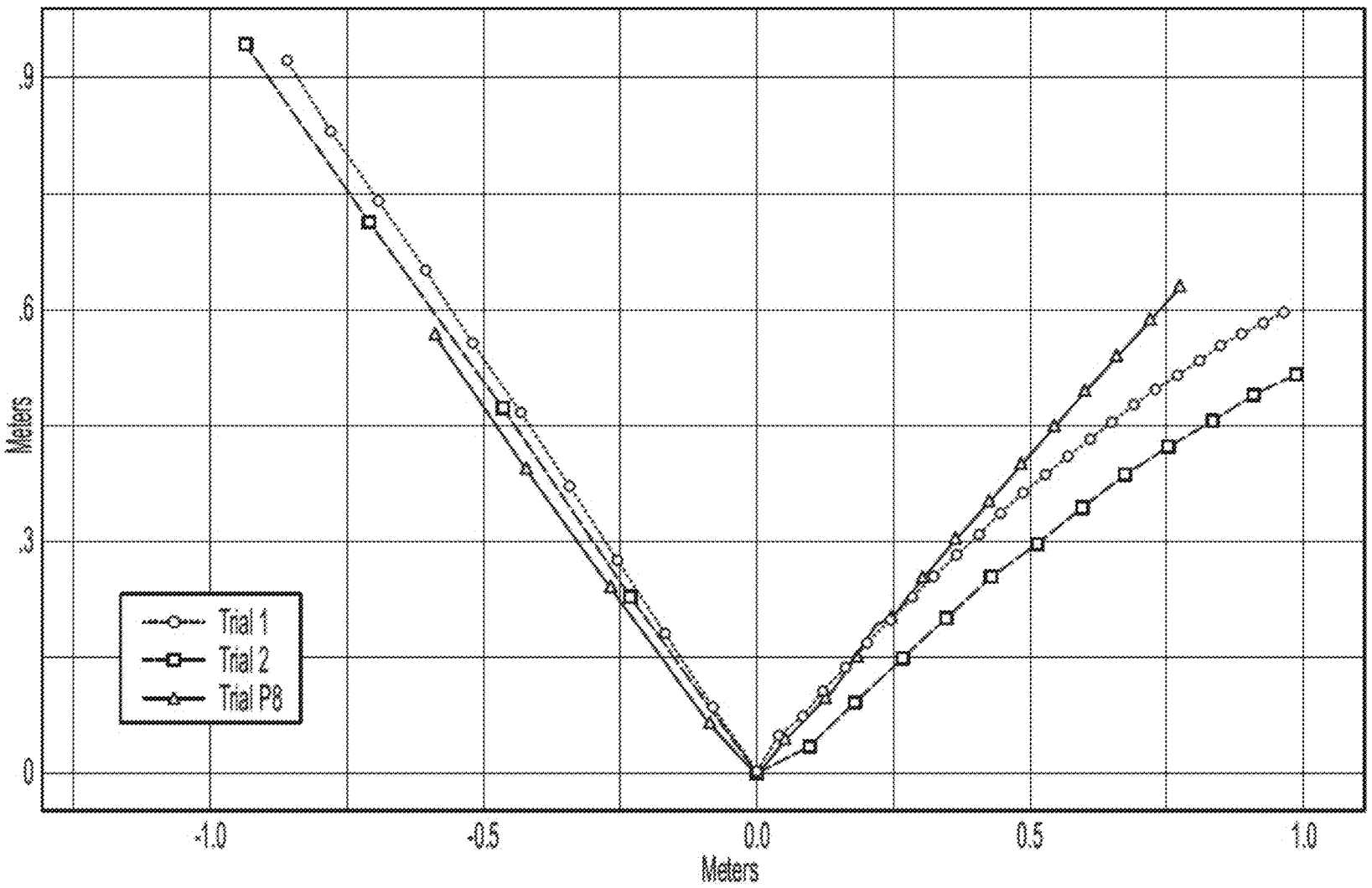
FIG. 11 depicts test results of the baseball bounce off an exemplary field comprising an exemplary pad (Trial P8) according to aspects of the present invention as compared to the baseball bounce off the commercially available artificial fields (Trial 1 and Trial 2).

Compression/Recovery properties of the inventive pad (recycled pad J) are shown in Table 5 and FIG. 4 (recovery line 402; compression line 404), while compression resistance of the inventive pad is reflected in Table 6.

TABLE 5

| Compression/Recovery | | | |
|---|---|---|---|
| Hours | Thickness (in) | Compression | Recovery |
| 0 | 0.888 | 0.00% | |
| 0 | 0.674 | 24.10% | 75.90% |
| 1 | 0.706 | 20.50% | 79.50% |
| 24 | 0.745 | 16.10% | 83.90% |
| 48 | 0.763 | 14.08% | 85.92% |

TABLE 6

| Compression Resistance | |
|---|---|
| Compression | Load |
| 25% | 5.37 lb |
| 65% | 149.27 lb |

The inventive pad has also been tested to determine its dimensional stability. The results are shown in Table 7.

TABLE 7

| Dimensional Stability of the Pad | | |
|---|---|---|
| Temperature Exposure (° F.) | Exposure Time | Dimensions[a] |
| 32 | 6 | 6" × 6" |
| 32 | 24 | 6" × 6" |
| 180 | 6 | 6" × 6" |
| 180 | 24 | 6" × 6" |
| Breaking strength (lb) | Warp | Fill |
| | 174 | 70 |
| Temperature | 32 F. | 180° F. |
| Avg. Doming (in) | −0.113 | −0.160 |
| Avg. Curling (in) | 0.025 | 0.103 |

[a]Tolerance 0.15%.

The thickness uniformity of an exemplary inventive pad, prepared according to the aspects of this disclosure, was measured according to ASTM D1777 standard and the results are shown in Table 8.

TABLE 8

| Thickness Uniformity Measurements of the Pad | | |
|---|---|---|
| Measurement Number | Thickness (mils) | Thickness (mm) |
| 1 | 707.6 | 17.97 |
| 2 | 654.1 | 16.61 |
| 3 | 657.35 | 16.70 |
| 4 | 696.8 | 17.70 |
| 5 | 704.5 | 17.89 |
| 6 | 679.6 | 17.26 |
| 7 | 695.8 | 17.67 |
| 8 | 676.6 | 17.19 |
| 9 | 697.7 | 17.72 |

TABLE 8-continued

| Thickness Uniformity Measurements of the Pad | | |
|---|---|---|
| Measurement Number | Thickness (mils) | Thickness (mm) |
| 10 | 684.5 | 17.39 |
| Average | 685.5 | 17.41 |
| Standard Deviation | 17.66 | 0.45 |
| Coefficient of Variation | 2.58 | 2.58 |

Example 2

The hydraulic transmissivity (horizontal drainage) of the inventive pad K, prepared according to the aspects of the current invention, was measured according to ASTM D4716 standard under conditions shown in Table 9. The hydraulic transmissivity results are shown in Table 10.

TABLE 9

| Test conditions for hydraulic transmissivity | | |
|---|---|---|
| Sample | System Description | Normal Compressive stress (psf) |
| K (0.5%) | Sample K position between plated with a 0.005 Hydraulic Gradient (0.5% slope) | 5 |
| K (1.0%) | Sample K position between plated with a 0.01 Hydraulic Gradient (0.1% slope) | 5 |

TABLE 10

| Hydraulic Transmissivity Results | | | | | | |
|---|---|---|---|---|---|---|
| Sample | Transmissivity ($m^2$/sec) | Unit Flow (gal/min/ft) | Unit Flow (gal/hr/ft) | Seating Time (hr) | Water Temp (° C.) | Specimen Size (inches) |
| K (0.5%) | 2.11E−04 | 0.005 | 0.29 | 0.25 | 17.7 | 12 × 12 |
| K (1.0%) | 2.11E−04 | 0.01 | 0.58 | 0.25 | 17.7 | 12 × 12 |

The permeability (vertical drainage) of the inventive pad L, prepared according to the aspects of the current invention was measured according to BS EN 1216:2003 standard using a single ring infiltrometer and a water temperature correct factor as required by EN12616. The results are shown in Table 11.

TABLE 11

| Permeability of the inventive pad | |
|---|---|
| Sample | Permeability Rate (in/hr) |
| Sample L | >100 |

The performance of the turf system comprising an inventive pad M prepared according to the aspects of the current disclosure was tested and the results are shown in Table 12.

TABLE 12

Performance of the turf system comprising an inventive pad.

| Characteristic | Test Method | Test Results |
|---|---|---|
| 355A "Flat" Gmax | ASTM F355A | 322 |
| 355A "Flat" HIC | ASTM F355A | 1453 |
| Critical Fall Height (m) | EN 1177: 2008 | 0.30 |
| Force Reduction (%) | ASTM F3189-17AAA | 37 |
| Vertical Deformation (mm) | ASTM F3189-17AAA | 5 |
| Energy Restitution (%) | ASTM F3189-17AAA | 56 |

To further test performance of the inventive pads, nine different pads have been prepared according to the compositions shown in Table 13 and incorporated into the turf system that also comprises a turf and an infill material.

TABLE 13

Pads composition

| Component | P1 | P2 | P3 | P4 | P5 | P6 | P7 | P8 | P9 |
|---|---|---|---|---|---|---|---|---|---|
| Recycled turf % | 70 | 70 | 70 | 70 | 70 | 70 | 70 | 70 | 70 |
| Bi-component PET, % | 15 | 15 | 15 | 15 | 15 | 20 | 20 | 30 | 30 |
| Other additives, % | 15 | 15 | 15 | 15 | 15 | 10 | 10 | 0 | 0 |
| mm | 16 | 12 | 14 | 16 | 18 | 18 | 21 | 17.5 | 20 |
| oz/yd$^2$ | 90 | 80 | 81 | 79 | 85 | 86 | 91 | 87 | 81 |

The results of the performance testing are shown in Table 14.

TABLE 14

Performance of the inventive pads

| Test | P1 | P2 | P3 | P4 | P5 | P6 | P7 | P8 | P9 |
|---|---|---|---|---|---|---|---|---|---|
| G-max | 99.4 | 105.2 | | 99.2 | 98.7 | 94 | 95.4 | 102.6 | 96 |
| HIC | 883.8 | 1197.8 | | 965.8 | 1001.8 | 983.4 | 795.6 | 1026.4 | 964.4 |
| Force Reduction | 66.12 | 65.69 | | 66.29 | 66.83 | 67.26 | 70.83 | 66.26 | 69.31 |
| Vertical Deformation | 10.56 | 10.27 | | 10.67 | 10.92 | 11.13 | 12.18 | 10.67 | 11.29 |
| Energy Restitution | 24.13 | 21.74 | | 21.28 | 23.07 | 22.25 | 21.66 | 24.39 | 25.83 |
| Shear Vane | 7 | 6.6 | | 6.8 | 6.4 | 5.7 | 6.2 | 6.3 | 6.1 |
| Rotational Traction | 37.2 | 36.4 | | 39.2 | 36 | 38.8 | 42.8 | 39.2 | 38.2 |

Figure 12:
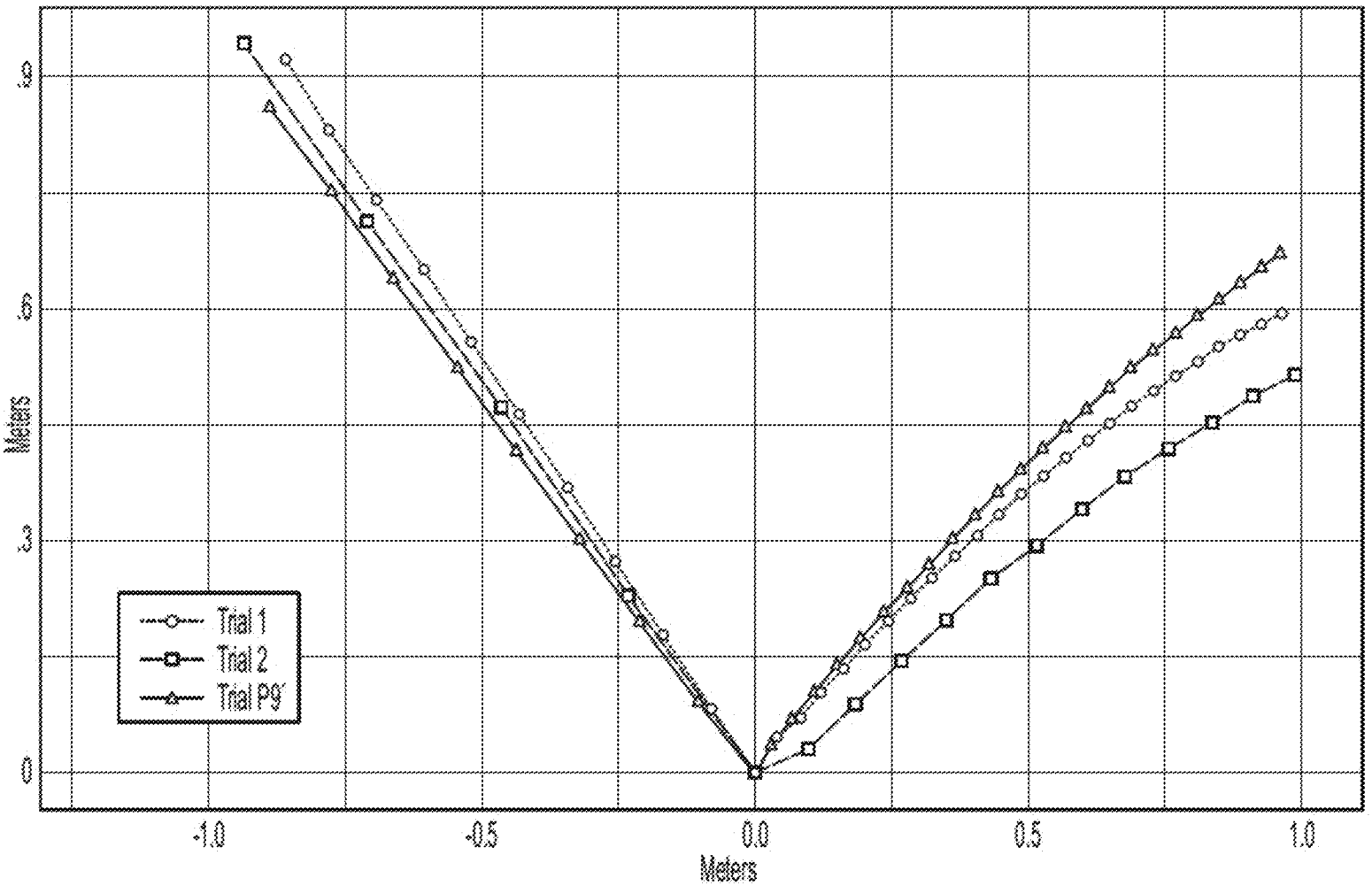
FIG. 12 depicts test results of the baseball bounce off an exemplary field comprising an exemplary pad (Trial P9'—dull) according to aspects of the present invention as compared to the baseball bounce off the commercially available artificial fields (Trial 1 and Trial 2).
Figure 13:
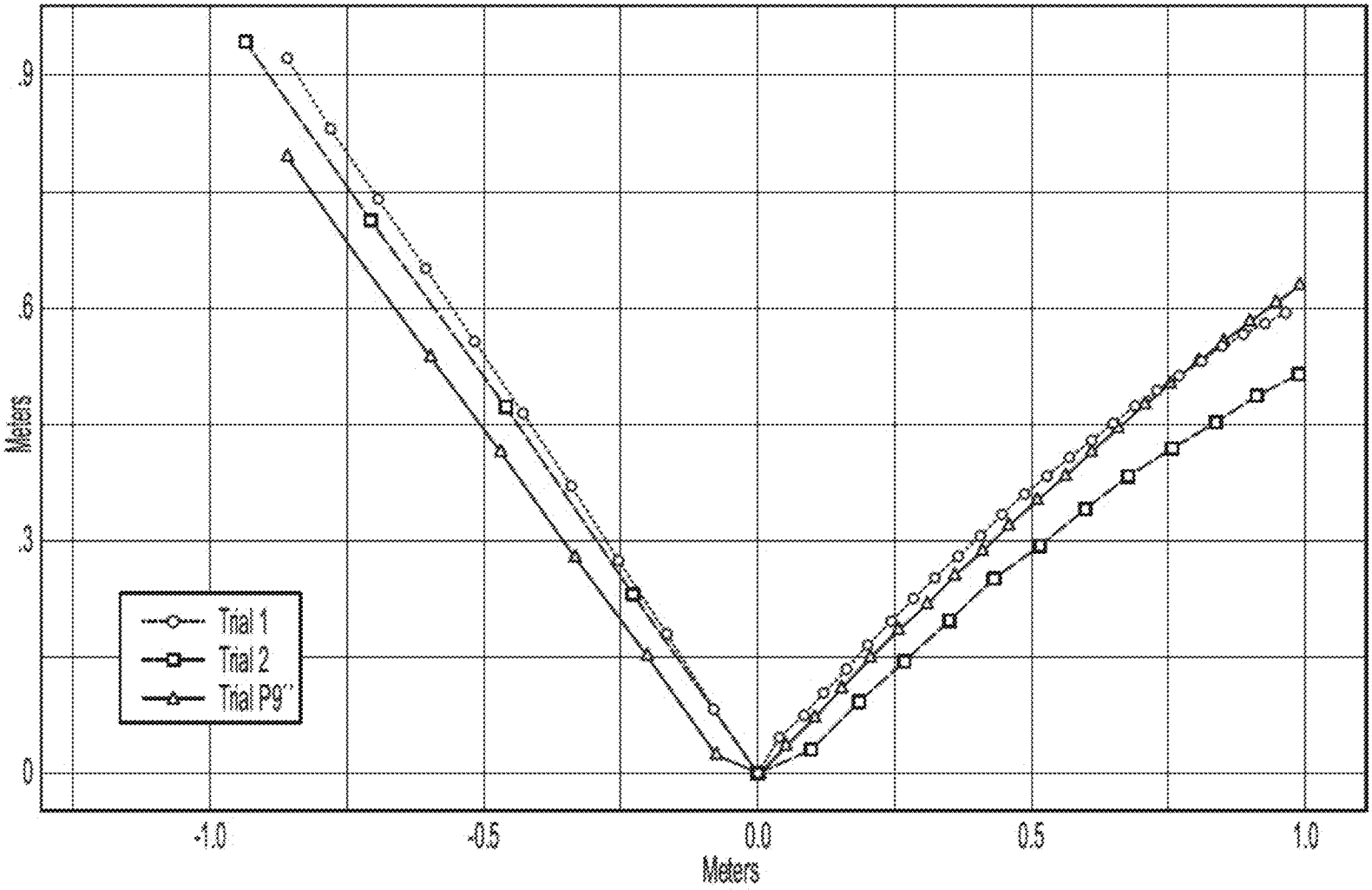
FIG. 13 depicts test results of the baseball bounce off an exemplary field comprising an exemplary pad (Trial P9"—shiny) according to aspects of the present invention as compared to the baseball bounce off the commercially available artificial fields (Trial 1 and Trial 2).
Figure 14:
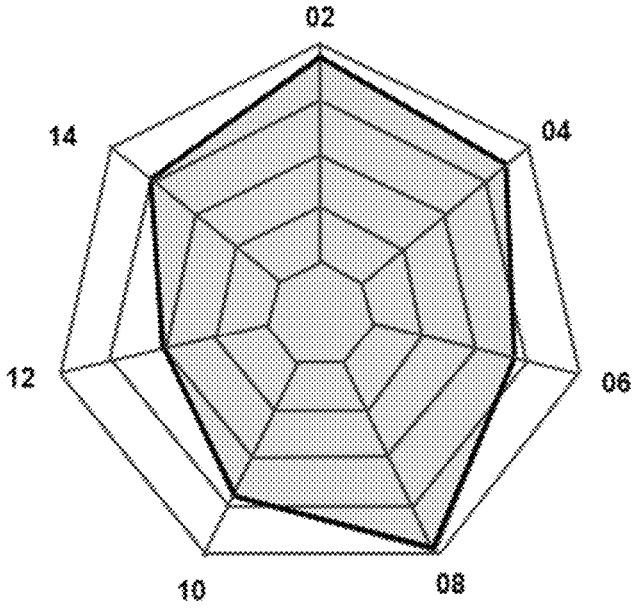
FIG. 14 depicts a spider chart showing performance characteristics of an exemplary pad (Trial P1).
Figure 15:
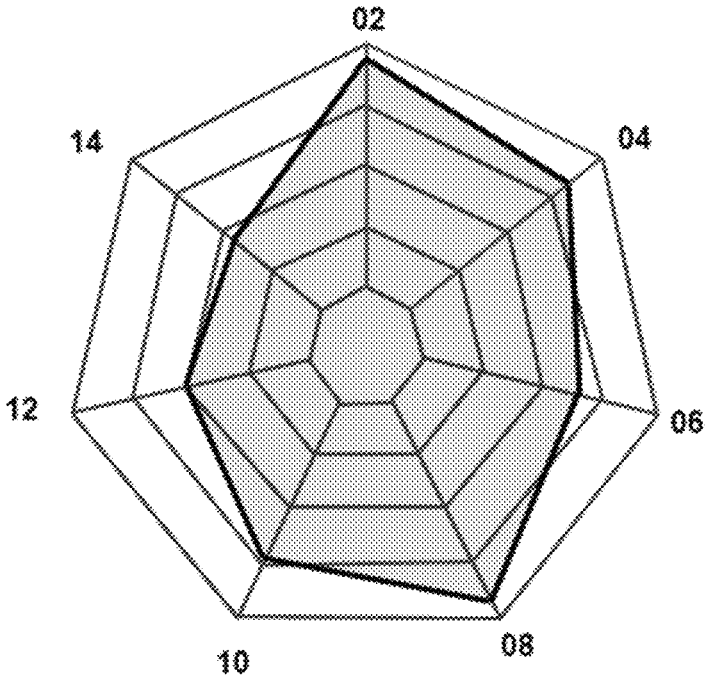
FIG. 15 depicts a spider chart showing performance characteristics of an exemplary pad (Trial P2).
Figure 16:
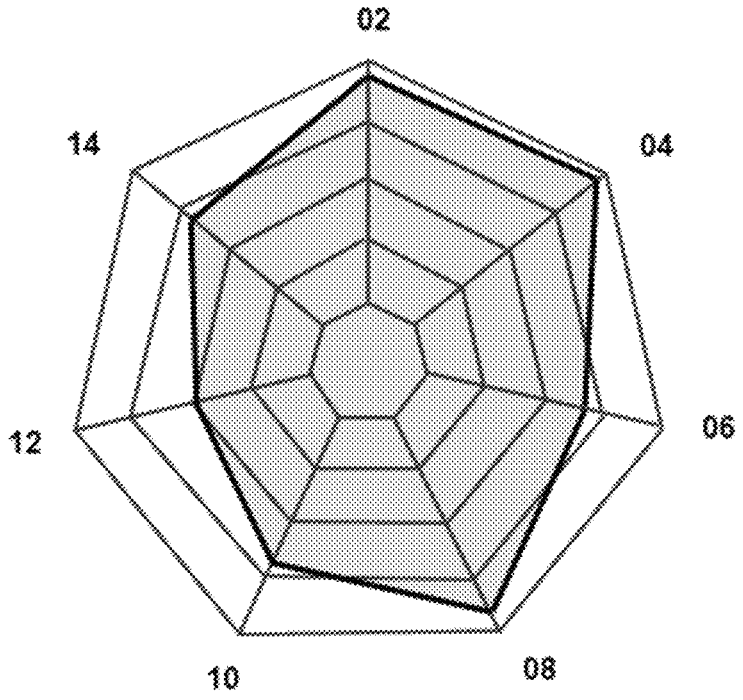
FIG. 16 depicts a spider chart showing performance characteristics of an exemplary pad (Trial P4).
Figure 17:
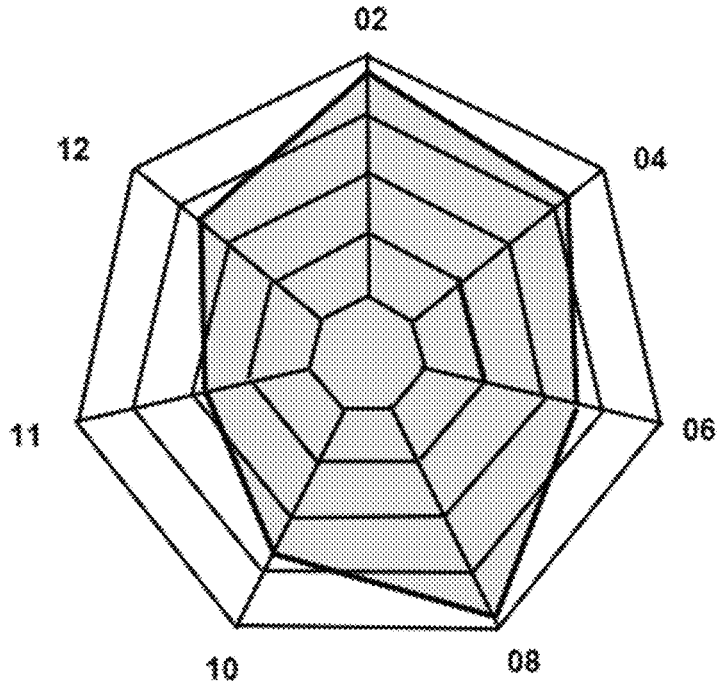
FIG. 17 depicts a spider chart showing performance characteristics of an exemplary pad (Trial P5).
Figure 18:
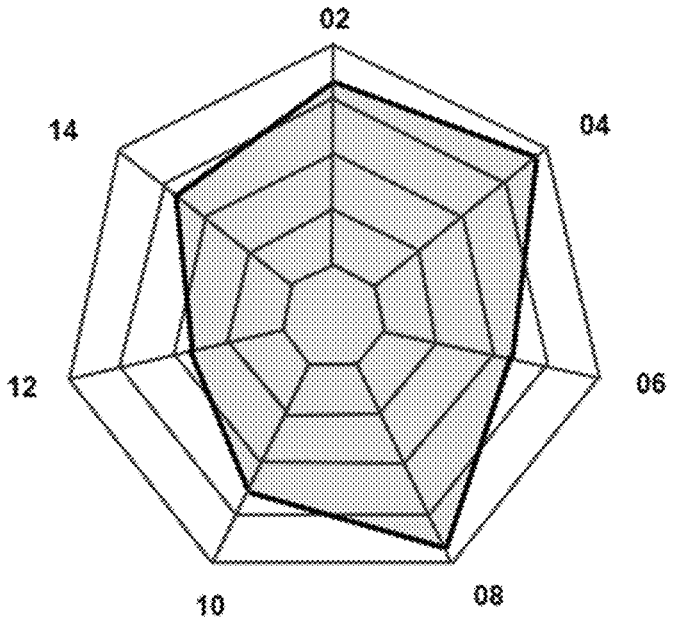
FIG. 18 depicts a spider chart showing performance characteristics of an exemplary pad (Trial P6).
Figure 19:
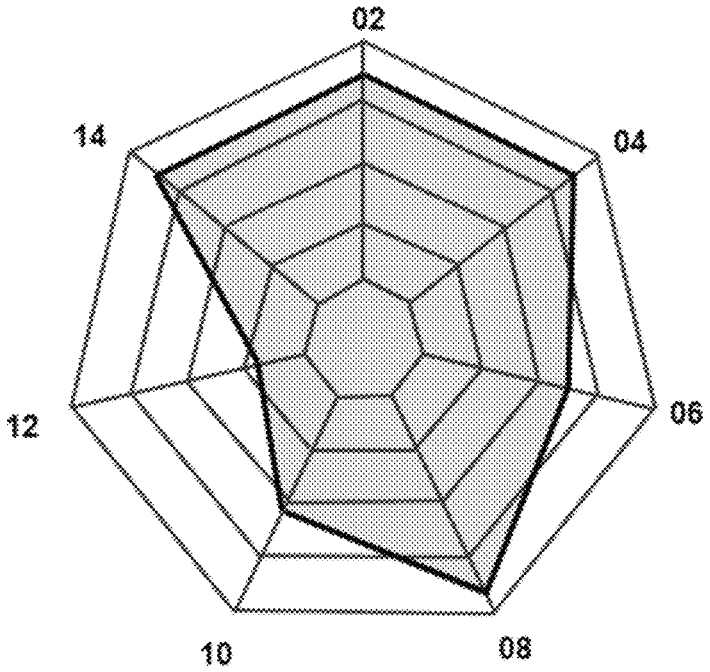
FIG. 19 depicts a spider chart showing performance characteristics of an exemplary pad (Trial P7).
Figure 20:
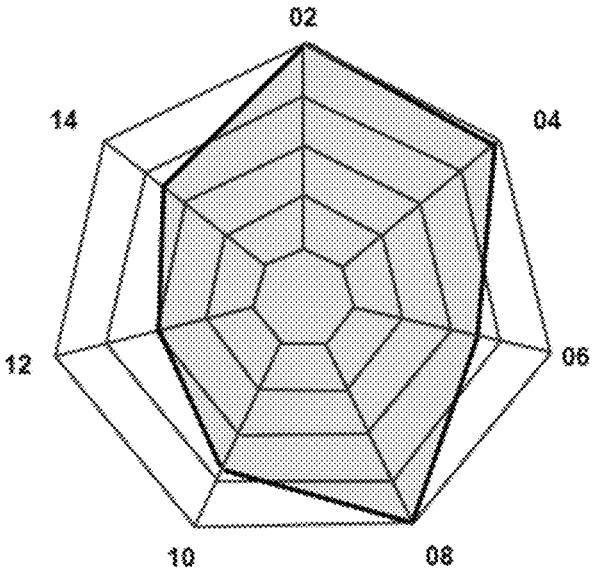
FIG. 20 depicts a spider chart showing performance characteristics of an exemplary pad (Trial P8).
Figure 21:
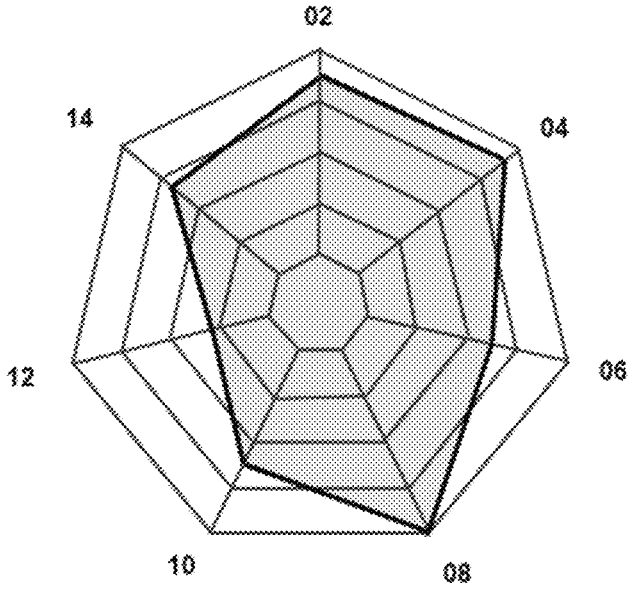
FIG. 21 depicts a spider chart showing performance characteristics of an exemplary pad (Trial P9).
Figure 22:
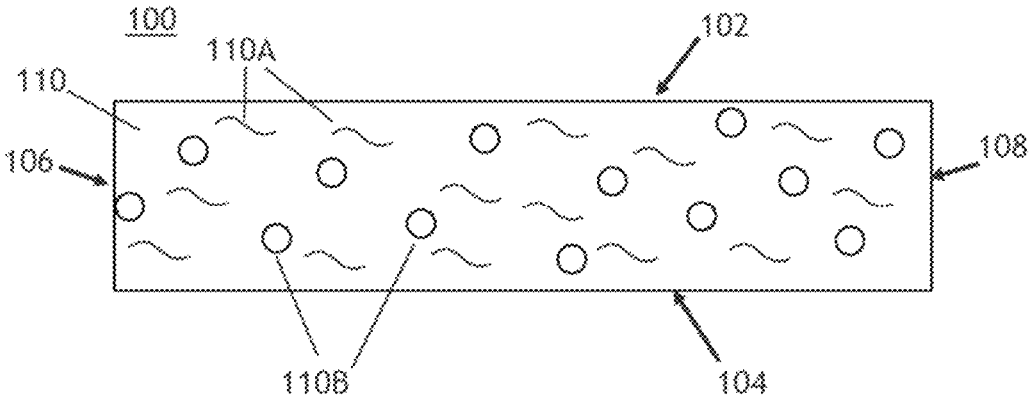
FIG. 22 depicts a schematic representation of an exemplary pad according to aspects of the present invention.
Figure 23:
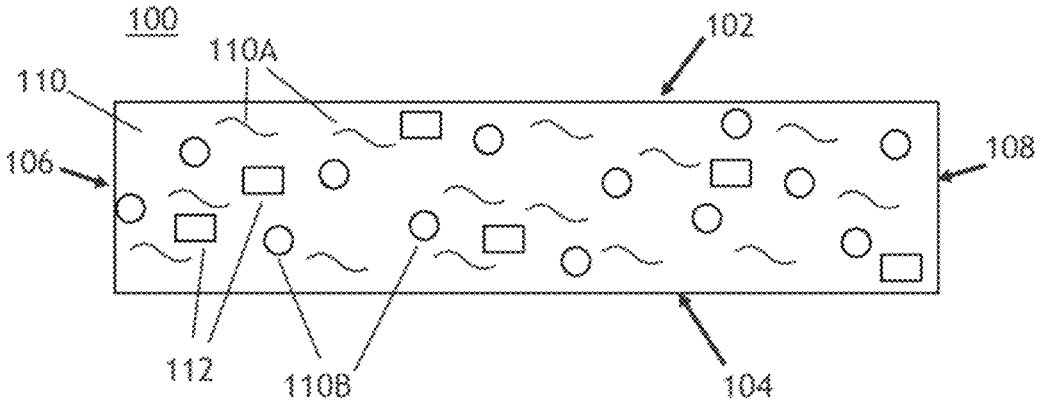
FIG. 23 depicts a schematic representation of an exemplary pad according to aspects of the present invention.
Figure 24:
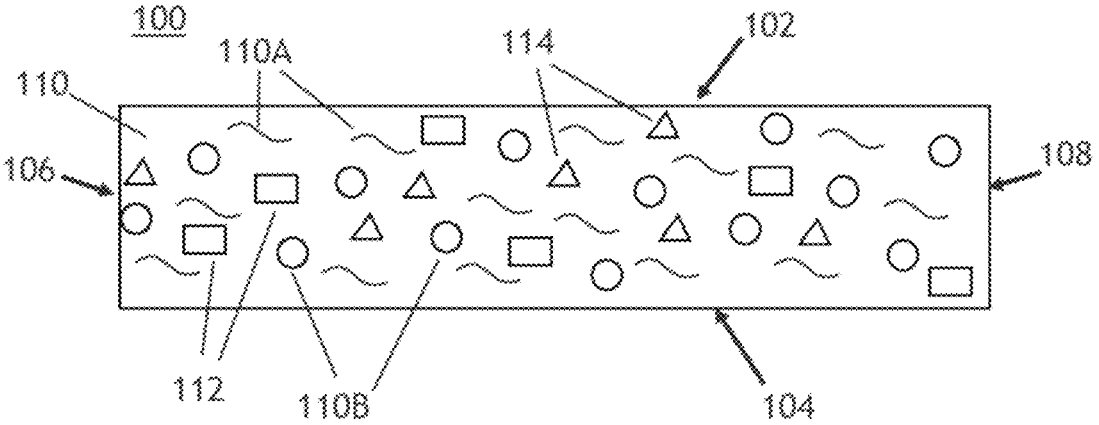
FIG. 24 depicts a schematic representation of an exemplary pad according to aspects of the present invention.
Figure 25A:
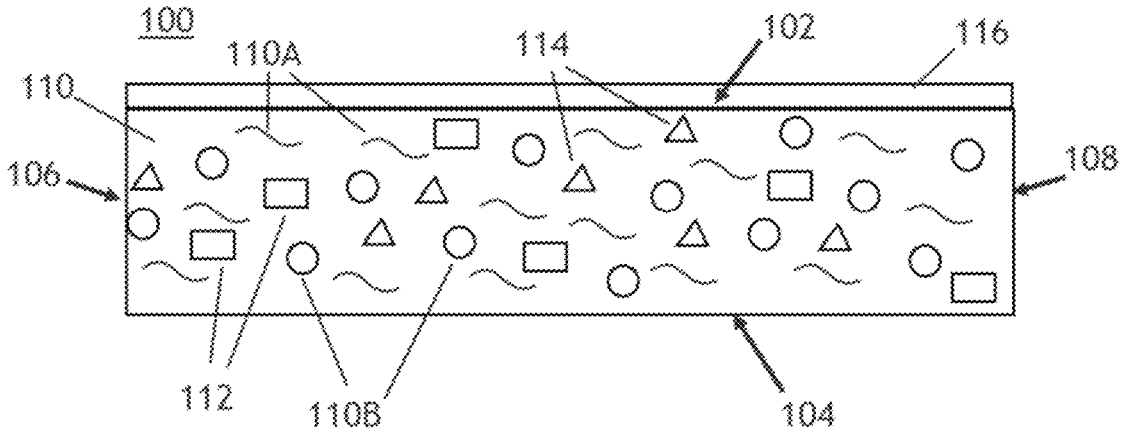
FIG. 25A and FIG. 25B depict schematic representations of an exemplary pad according to aspects of the present invention.
Figure 25B:
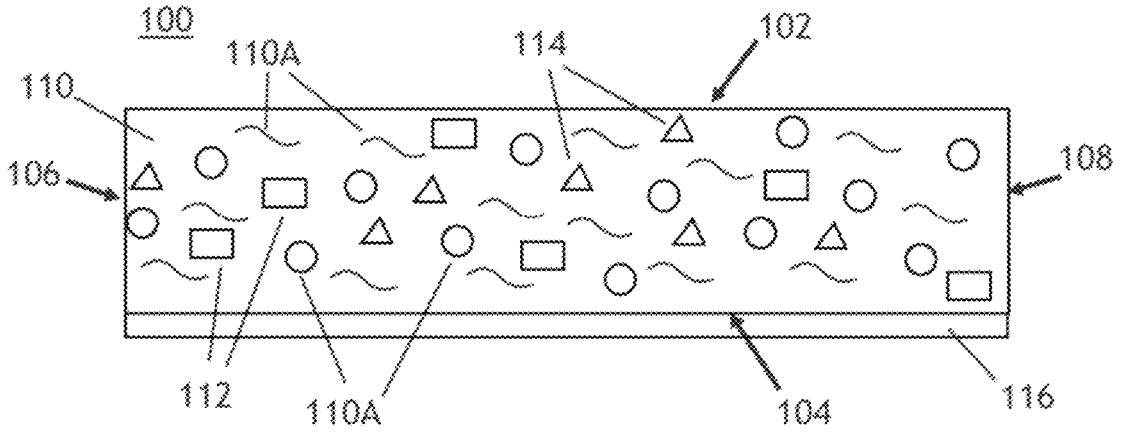

FIG. 5 through FIG. 13 show a baseball bounce off the turfs comprising P1, P2, and P4 through P9 pad compositions respectively. The ball bounce was measured off a baseball shot at a 45-degree angle at a speed between 20 and 50 MPH. The baseball bounce off the turfs comprising the inventive pad was compared to the baseball bounce off other commercially available turfs (Trial 1 and Trial 2). FIG. 12 shows a baseball bounce off the turf comprising a dull P9 composition (Trial P9'), while FIG. 13 shows a baseball bounce off the turf comprising a shiny P9 composition (Trial P9"). In certain aspects and as it is used herein, the terms "dull" and "shiny" refer to the appearance of one side of the pad versus the other. It is understood that these two compositions can test differently depending on which side is installed face up ("grass"). The change in appearance can be achieved by adding extra heat via infra read (IR) heating to the product after it is formed and compressed in the oven. Other methods achieving those compositions can be done by, for example and without limitation, singeing with a hot roller or a flame.

FIG. 14 through FIG. 21 show performance results of the fully installed turfs comprising pads P1, P2, and P4 through P9, respectively, as summarized in the Spider Chart. The spider chart is used to graphically display multivariate data in the form of a two-dimensional chart of three or more quantitative variables represented on axes starting from the same point. The chart consists of a sequence of equi-angular spokes, called radii, with each spoke representing one of the variables, for example, 02—represents G-max value; 04—represents Rotational Traction; 06—represents Shear Vane; 08—represents Energy Restitution; 10—represents Vertical Deformation, 12—represents Force Reduction, and 14—represents HIC. The data length of each spoke is proportional to the magnitude of the variable for the data point relative to the maximum magnitude of the variable across all data points.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A shock absorbing pad, comprising:

a composite nonwoven pad having a face surface and an opposed back surface and comprising a nonwoven blend of at least four reclaimed artificial turf materials and a heat set binder material, wherein the at least four reclaimed artificial turf materials comprise face fibers, primary backing fibers, adhesive backing, and an artificial turf infill material, wherein the artificial turf infill material is embedded within the composite nonwoven pad, and wherein the artificial turf infill material comprises at least one of silica sand, rubber crumb granules, organic component, ethylene propylene diene monomer (EPDM) rubber, thermoplastic elastomers, polyurethane or any combination thereof.

2. The shock pad of claim 1, further comprising at least one performance additive embedded within the nonwoven blend.

3. The shock pad of claim 2, wherein the at least one performance additive comprises a virgin polymeric material, high denier fibers, a low melt fibers, a resilient material, foam chips, rubber chips, cork, wood chips, silica sand, adhesive material, binder fibers, or any combination thereof.

4. The shock pad of claim 1, wherein the reclaimed artificial turf material comprises a thermoset polymer, a thermoplastic polymer, or a combination thereof.

5. The shock pad of claim 1, wherein the nonwoven blend further comprises at least one reclaimed carpet material.

6. The shock pad of claim 5, wherein the reclaimed carpet material comprises a post-consumer carpet material, a post-industrial carpet material, or a combination thereof.

7. The shock pad of claim 1, wherein the heat set binder is a low melt fiber.

8. The shock pad of claim 1, wherein the heat set binder is a bi-component fiber.

9. The shock pad of claim 1, wherein the reclaimed artificial turf material comprises a polyolefin, polyamide, polystyrene, polyurethane, polyester, polyvinyl chloride, polyacrylic, or any combination thereof.

10. The shock pad of claim 9, wherein polyolefin comprises a polyethylene, polypropylene, or a combination thereof.

11. The shock pad of claim 9, wherein the polyamide is nylon 6, nylon 6,6, nylon 1,6, nylon 12, nylon 6,12, or a combination thereof.

12. The shock pad of claim 9, wherein the polyester comprises polyethylene terephthalate, polypropylene terephthalate, polybutylene terephthalate, or any combination thereof.

13. The shock pad of claim 1, further comprising a reinforcing scrim adhered to one of the face surface or back surface.

14. The shock pad of claim 13, wherein the reinforcing scrim comprises a non-woven fiberglass, a wet-laid fiberglass, a non-woven thermoplastic fabric, a woven thermoplastic fiber, or a combination thereof.

15. The shock pad of claim 1, wherein the shock pad has a density from about 2 lbs/ft$^3$ to about 30 lbs/ft$^3$.

16. The shock pad of claim 1, further having a thickness extending between the face surface and the opposed back surface that is from about 0.1 in to about 5 in.

17. The shock pad of claim 1, wherein when the shock pad is present as a component in an artificial turf system, the artificial turf system exhibits a Gmax value less than about 165 g's as measured according to ASTM F-355.

18. The shock pad of claim 1, wherein when the shock pad present as a component in an artificial turf system, the artificial turf system exhibits a Head Impact Criterion of less than about 1,000 as measured according to EN 1177 test.

19. The shock pad of claim 1, wherein the shock pad exhibits a compression set from about 1% to about 30% as measured according to ASTM D-3676 or ASTM D-3574.

20. The shock pad of claim 1, wherein the composite nonwoven pad defines a plurality of channels extending from the face surface to the opposed back surface.

21. The shock pad of claim 20, wherein the plurality of channels are configured to provide a predetermined rate of horizontal drainage of moisture through the composite nonwoven pad from the face surface through the opposed back surface.

22. The shock pad of claim 21, wherein the each of the plurality of channels has a diameter in the range of from about 1 mm to about 15 mm.

23. The shock pad of claim 20, wherein the predetermined rate of horizontal drainage is from about 10 in/h to about 7,000 in/h.

24. The shock pad of claim 20, wherein the plurality of channels are configured to provide a predetermined rate of vertical drainage of moisture through the composite nonwoven pad from the face surface through the opposed back surface.

25. The shock pad of claim 24, wherein the vertical drainage is greater than 100 in/h.

26. The shock pad of claim 1, further comprising a moisture barrier film adhered to the opposed back surface.

27. The shock pad of claim 26, wherein the shock pad exhibits a rate of lateral drainage between about 10 to about 7,000 in/h.

28. The shock pad of claim 1, wherein the composite nonwoven pad comprises opposed first and second side edges and wherein the plurality of side edges define an edge locking structure.

29. The shock pad of claim 1, wherein the composite nonwoven pad is a roll good.

30. The shock pad of claim 1, wherein the composite nonwoven pad is a slab or panel.

31. An artificial turf system comprising:

a) an artificial turf comprising a primary backing layer having a face side and a back side and a plurality of turf fibers extending through the backing layer such that a face side portion of the turf fibers extends from the face side of the backing layer, and b) the shock absorbing pad according to claim 1, wherein the back side of the artificial turf overlies the face surface of the composite nonwoven pad, wherein the artificial turf system exhibits a Gmax value less than about 165 g's as measured according to ASTM F-355, and a Head Impact Criteria of less than about 1,000 as measured according to EN 1177 test.

32. The artificial turf system of claim 31, wherein the artificial turf system exhibits a compression set from about 1% to about 30% as measured according to ASTM D-3676 or ASTM D3574.

* * * * *